US011014058B2

(12) United States Patent
Konietzko

(10) Patent No.: US 11,014,058 B2
(45) Date of Patent: May 25, 2021

(54) INTERCHANGEABLE PHARMACEUTICAL FORMULATION PRODUCTION DEVICE LIFTING ARM, AND PHARMACEUTICAL FORMULATION PRODUCTION DEVICE FOR PRODUCING A PHARMACEUTICAL INDIVIDUAL PRODUCT

(71) Applicant: GAKO INTERNATIONAL GMBH, München (DE)

(72) Inventor: Matthias Konietzko, Bamberg (DE)

(73) Assignee: GAKO INTERNATIONAL GMBH, Munich (DE)

( * ) Notice: Subject to any disclaimer, the term of this patent is extended or adjusted under 35 U.S.C. 154(b) by 373 days.

(21) Appl. No.: 15/753,498

(22) PCT Filed: Aug. 17, 2016

(86) PCT No.: PCT/EP2016/069506
§ 371 (c)(1),
(2) Date: Feb. 19, 2018

(87) PCT Pub. No.: WO2017/029321
PCT Pub. Date: Feb. 23, 2017

(65) Prior Publication Data

US 2018/0243703 A1 Aug. 30, 2018

(30) Foreign Application Priority Data

Aug. 20, 2015 (DE) ..... 10 2015 113 819.0

(51) Int. Cl.
*B01F 11/00* (2006.01)
*B01F 15/00* (2006.01)

(52) U.S. Cl.
CPC .... *B01F 11/0054* (2013.01); *B01F 15/00733* (2013.01); *B01F 2215/0032* (2013.01)

(58) Field of Classification Search
CPC ..... B01F 11/0054; B01F 15/00733
See application file for complete search history.

(56) References Cited

U.S. PATENT DOCUMENTS

2003/0099153 A1 5/2003 Renfro
2006/0087913 A1 4/2006 Leong

FOREIGN PATENT DOCUMENTS

DE 29724902 U1 8/2005
DE 202008015722 * 4/2010
DE 202008015722 U1 4/2010

OTHER PUBLICATIONS

Machine Translation of DE202008015772 to Dolinski Publishes Feb. 19, 2009 (Year: 2009).*

(Continued)

*Primary Examiner* — Anshu Bhatia
(74) *Attorney, Agent, or Firm* — Bachman & LaPointe, P.C.

(57) ABSTRACT

An inventive exchangeable pharmacy formulation preparation device lifting arm (28) for being arranged at a lifting unit (12) of a pharmacy formulation preparation device (2) for preparing an individual pharmaceutical product and for attaching a mixing vessel (32) for such an individual pharmaceutical product thereto comprises a substantially elongated basic body, in which an elongated recess (64) for sliding the basic body onto a lifting unit fixing pin (62) is provided, the elongated recess (64) extending from a first longitudinal end (40) of the basic body over part of the longitudinal direction of the basic body towards the opposite second longitudinal end (42); wherein the first longitudinal end (40) of the basic body comprises a stopping region (45) for a front surface (16) of the lifting unit (12) and a bearing region (44) for a supporting surface (18) of the lifting unit (12); and wherein a fastening unit (30) for a mixing vessel (Continued)

(32) is provided at the or close to the second longitudinal end (42) of the basic body.

11 Claims, 10 Drawing Sheets

(56) References Cited

OTHER PUBLICATIONS

DE202008015722 to Hettich and Machine Translation (Year: 2008).*
International Search Report for PCT/EP2016/069506 dated Oct. 24, 2016.

* cited by examiner

28

56

INTERCHANGEABLE PHARMACEUTICAL FORMULATION PRODUCTION DEVICE LIFTING ARM, AND PHARMACEUTICAL FORMULATION PRODUCTION DEVICE FOR PRODUCING A PHARMACEUTICAL INDIVIDUAL PRODUCT

BACKGROUND

The invention relates to an exchangeable pharmacy formulation preparation device lifting arm and a pharmacy formulation preparation device for preparing an individual pharmaceutical product.

A device for agitating and preparing mixtures or the like in an agitating vessel are known from the German utility model DE 277 24 902 U1. Even though this device has proven to be suitable for everyday pharmacy routine for preparing individual pharmaceutical products, the inventor of the present subject matter has realized that many mixing vessels already existing on the market or newly introduced mixing vessels cannot be employed for such a device.

Therefore, an object of the present invention is to provide a pharmacy formulation preparation device for preparing an individual pharmaceutical product, which can be operated with a variety of mixing vessels already existing on the market or with mixing vessels newly introduced to the market. Furthermore, corresponding components for such a pharmacy formulation preparation device are to be provided, which allow an expansion of this field of application.

This object is achieved by the subject matter of the independent patent claims. Advantageous further embodiments result from the dependent claims.

An inventive exchangeable pharmacy formulation preparation device lifting arm for arranging a pharmacy formulation preparation device at a lifting unit for preparing an individual pharmaceutical product and for attaching a mixing vessel for such an individual pharmaceutical product comprises a substantially elongated basic body, in which an elongated recess for sliding the basic body onto a lifting unit fixing pin is provided, the elongated recess extending from a first longitudinal end of the basic body over part of the longitudinal direction of the basic body towards the opposite second longitudinal end, wherein the first longitudinal end of the basic body comprises a stopping region for a front surface of the lifting unit and a bearing region for a supporting surface of the lifting unit, and wherein a fastening unit for a mixing vessel is provided at the or close to the second longitudinal end of the basic body.

According to findings underlying the invention, the restriction that always only one specific mixing vessel type can be used in conventional pharmacy formulation preparation devices, such as shown in DE 297 24 902 U1 for example, results from the fact that always only one fastening unit for one mixing vessel is attached at the lifting arm, which only allows for attaching a specific type of mixing vessels.

According to further findings underlying the invention, the inventor of the present subject matter has found that the existing lifting arm, which is fixedly connected to the device, cannot be provided with different fastening units able to reliably receive the different mixing vessels available on the market. One reason is that there already is a wide variety of different mixing vessels and new types are constantly added.

SUMMARY

According to a basic idea of the invention, the pharmacy formulation preparation device lifting arm is therefore designed in an exchangeable manner and is received by the lifting unit on the pharmacy formulation preparation device side and slid thereon or fixed to it in a clamping or magnetic manner.

To this end, the inventive pharmacy formulation preparation device lifting arm and the inventive lifting unit on the device side each comprise a corresponding interface, which is formed by the elements of the lifting arm defined in the independent lifting arm claim: elongated recess, stopping region and bearing region, and which is, on the lifting unit side, formed by the elements defined in the independent device claim: lifting unit fixing pin, front surface and supporting surface. In other words, the lifting arm, which is fixedly connected to the respective device in the conventional devices, has, according to the invention, been replaced with a lifting unit, which is still securely connected to the device and is displaceable upwards and downwards, and with an exchangeable lifting arm or a plurality of exchangeable lifting arms, which can be received by the lifting unit, and can in particular be slid thereon and, if applicable, additionally fixed thereto.

A lifting arm can thus, with its elongated recess, easily be slid onto the lifting unit fixing pin of the lifting unit until its stopping region abuts the front surface of the lifting unit and its bearing region comes to rest on the supporting surface of the lifting unit. This achieves a positioning of the lifting arm relative to the lifting unit, which is especially easy to perform and at the same time sufficiently secure, wherein at the same time, the lifting arm can be securely and reliably prevented from twisting relative to the lifting unit and moving on backwards, which is sufficient for a reliable operation and mixing procedure. Such an interface according to the invention is practical, easy to implement and ensures a quick exchange of lifting arms.

In addition, different types of lifting arms can be employed, for example, lifting arms, in which the fastening unit for the mixing vessel is adapted as a threaded section, in which a mixing vessel provided with an outer thread on its fastening extension is screwed in, for example, or lifting arms, in which the fastening unit for the mixing vessel is adapted as a contact area and as a further fastening mechanism.

A fastening unit for a mixing vessel is provided at or close to the second longitudinal end of the basic body of the lifting arm. Therefore, a plurality of different lifting arms can be provided and employed and operated together with the device, wherein the lifting arms may comprise different fastening units to be able to employ the already available mixing vessels as well as the mixing vessels additionally introduced to the market. According to the invention, it can thereby be ensured that all mixing vessels already available on the market can indeed be employed with the device according to the invention.

The mixing vessels according to the invention are so-called crocks for preparing individual pharmaceutical products in pharmacies. Such individual pharmaceutical products may be ointments, semisolid preparations, pastes, creams, gels, emulsions, eye drops, lotions, pills, capsules or teas. Typically, such crocks have no neck or do not narrow in any way on the upper side but have a cylindrical interior space such that the individual pharmaceutical products prepared therein can easily be completely taken out, for example using a spatula. Furthermore, the cylindrical basic body allows the agitating tool to reach the entire interior of the pharmacy formulation preparation crock, thereby allowing for even grinding even very small agglomerates of active ingredients.

According to a first embodiment of the invention, the stopping region is formed by the front surface of the first longitudinal end of the basic body and/or the bearing region is formed by the end region of the lower side of the basic body. The stopper on the lifting arm side and the bearing region on the lifting arm side do not necessarily have to be adapted as continuous areas but may also be provided as several separated partial areas or, in an extreme case, even as a number of stopper points or bearing points.

According to another embodiment of the invention, the fastening unit comprises a mixing vessel fastening extension fastening region, which is adapted as a recess extending from the lower side to the upper side of the basic body.

According to another embodiment of the invention, the recess has a substantially cylindrical shape, and/or the inner surface of the recess has at least one threaded region provided thereon for screwing a mixing vessel thereon. This makes it possible to easily attach a mixing vessel, in particular comprising an outer thread on a fastening protrusion thereof, to the lifting arm, reliably hold it thereon and easily detach it therefrom.

According to another embodiment of the invention, the fastening unit is adapted as a fastening claw having two claw extensions, wherein the fastening claw comprises a mixing vessel fastening extension fastening region, which is adapted as a recess extending from the lower side to the upper side of the basic body, and an agitating stick insertion region, which is adapted as a recess extending from the lower side to the upper side of the basic body and extends from the second longitudinal end of the basic body to the mixing vessel fastening extension fastening region.

According to another embodiment of the invention, the recess of the mixing vessel fastening extension fastening region has a substantially cylindrical shape and/or the inner surface of the recess of the mixing vessel fastening extension fastening region has at least one threaded region provided thereon for screwing a mixing vessel thereon and/or the recess of the agitating stick insertion region comprises two inner faces facing each other having a substantially constant distance.

In these embodiments, a mixing vessel having an agitating stick protruding from the mixing vessel can be reliably fastened to the lifting arm, reliably be held thereon and easily be detached therefrom by sliding it on from the front and subsequently screwing it in, instead of sliding it on from below. Many users feel that inserting the mixing vessel from the front is easier and more convenient.

According to another embodiment of the invention, the distance between the two inner sides of the agitating stick insertion region facing each other decreases from the second longitudinal end of the basic body towards the mixing vessel fastening extension fastening region, whereby the mixing vessel with the agitating stick is, during insertion, guided towards the mixing vessel fastening extension fastening region.

The mixing vessel fastening extension fastening region can preferably be arranged as an extension of the elongated recess. In other words: the mixing vessel fastening extension fastening region and the elongated recess are arranged at the center with respect to the width of the lifting arm, leading to a balanced weight distribution across the width. The main extension direction of the claw extensions may extend substantially parallel to the main extension direction of the elongated recess, or be an extension thereof.

According to another embodiment of the invention, the recess of the mixing vessel fastening extension fastening region comprises an upper substantially cylindrical recess region and a lower substantially cylindrical recess region having a larger diameter, wherein, at the transition between the lower and the upper substantially cylindrical recess region, a supporting surface, in particular of an annular shape, is provided facing downwards, which forms a stopper for a step of a fastening extension of a mixing vessel; and/or wherein the upper recess region comprises at least one threaded region for screwing a mixing vessel thereon. According to this embodiment, the lifting arm is adapted for mixing vessels the fastening extension of which has a step-like shape, for example having an upper narrower threaded section and a lower wider step section.

According to another embodiment, at the upper end of the upper substantially cylindrical recess region, the mixing vessel fastening extension fastening region comprises a screw-in limiting region having a smaller inner diameter than the inner diameter of the inner thread of the mixing vessel fastening extension fastening region. Therefore, the screw-in limiting region forms a screw-in limiting surface on its lower side towards the lower substantially cylindrical recess region, the screw-in limiting surface forming a stopper for a stopper surface of a fastening extension. This allows for a particularly preferable attaching option for the fastening extension of the crock lid, the crock bottom or the crock adapter within the crock fastening extensions fastening region of the lifting arm.

According to an alternative embodiment of the lifting arm, the fastening unit further comprises a contact area for a mixing vessel provided within the basic body, an upper clamping body for the lid plate or a bottom plate of the mixing vessel, and at least one, in particular two, displaceable rod(s), by means of which the upper clamping body can be displaced relative to the basic body in the vertical direction. With such a lifting arm, the mixing vessel can be easily placed on the contact area and can be reliably supported opposite to the lifting arm, in particular in a clamping manner, by means of the displaceable rod(s) and the upper clamping body.

According to another embodiment, the at least one displaceable rod is fixed to the upper clamping body or to the basic body and is displaceable with respect to the respective other element of the upper clamping body or the basic body and can be locked in a desired height position by means of at least one locking lever. This is a variant which is easy to implement and by means of which the mixing vessel can be reliably mounted with respect to the lifting arm and easily be detached therefrom.

According to another embodiment, the clamping body comprises a guiding attachment for an agitating stick arranged in a mixing vessel, and/or the upper clamping body comprises a guiding recess, which is in particular open towards the front, for a fastening extension of the mixing vessel. Therefore, the mixing vessel can be mounted in an even more reliable manner and at the same time be easily detached.

In order to hold the lifting arm even more reliably in its position on the lifting unit and in order to reliably prevent the lifting arm from sliding towards the front, the lifting arm may be fixed to the lifting unit in different ways. These variants of fixing the lifting arm to the lifting unit described below may be provided as an alternative or in any combination.

According to a first fixing variant according to the invention, the pharmacy formulation preparation device lifting arm is adapted for being magnetically fixed to a lifting unit of a pharmacy formulation preparation device for preparing an individual pharmaceutical product and for attaching a mixing vessel for such an individual pharmaceutical product thereto. At the front end of the elongated recess of the basic body, a magnetic pin opening is provided, extending in a radial direction and having a pin with a magnet, in particular a permanent magnet, inserted therein. The pin with the magnet can substantially be moved in a radial direction between a position of magnetic attraction, in which the magnet is arranged at a front end of the elongated recess of the basic body, and a release position, in which the magnet is displaced radially outwards from the front end of the elongated recess.

This variant of magnetically fixing the lifting arm to the lifting unit holds the lifting arm reliably on the lifting unit, in particular on the lifting unit fixing pin of the same, wherein such a lifting arm according to the invention can at the same time easily be arranged on the lifting unit and magnetically fixed thereto, while the lifting arm can be as easily detached therefrom as well. Moving the pin from the position of magnetic attraction to the release position and vice versa is very easy, intuitive and convenient. The magnetic attraction force acting in the position of magnetic attraction between the front end of the lifting unit fixing pin within the elongated recess of the basic body and the magnet also provides for the lifting arm to be moved as far as possible towards the lifting unit, in particular to an extent that the stopping region on the first longitudinal end of the basic body abuts on the front surface of the lifting unit.

For this first variant of the magnetic fixing, at least the front region of the lifting unit fixing pin should be magnetic. To this end, a magnet, which is adapted such as to attract the magnet of the pin of the lifting arm, may be arranged either at the front end of the lifting unit fixing pin, or at least the front end of the lifting unit fixing pin, in particular the entire lifting unit fixing pin, comprises a ferromagnetic material.

According to a first embodiment of the first fixing variant of the lifting arm, the magnetic pin opening extends transversely through the basic body and comprises a first section having a smaller diameter and a second section having a larger diameter; and/or the pin with the magnet comprises a first section having a smaller diameter and a second section having a larger diameter; and/or at the end of the magnetic pin opening having the larger diameter, a spring, in particular a screw pressure spring, is arranged, in particular having a closing cap with respect to the basic body. Therefore, the pin with the magnet is received in the basic body of the lifting arm in a reliable and slide-proof manner and is automatically pretensioned in a specific position, in particular in the position of magnetic attraction.

According to another embodiment of the first fixing variant of the lifting arm, the spring pretensions the pin with the magnet such that the annular step of the pin between the first section having the smaller diameter and the second section having the larger diameter abuts the annular stopper of the magnetic pin opening between the first section having a smaller diameter and the second section having a larger diameter; that the magnet is arranged in its position of magnetic attraction at the front end of the elongated recess of the basic body; and that the end region of the first section having a smaller diameter of the pin protrudes from the magnetic pin opening. Therefore, the lifting arm is automatically pretensioned in the position of magnetic attraction and the pin is usually only operated by a user when the lifting arm is to be detached from the lifting unit, in particular from the lifting unit fixing pin thereof.

According to another embodiment of the first fixing variant of the lifting arm, the spring and the pin are adapted such that the pin with the magnet is, when the end region of the first section of the pin having a smaller diameter is manually pressed into the magnetic pin opening, in particular to an extent that the end region of the pin is substantially positioned within the plane of the respective outer side of the basic body, in the release position and the magnet is displaced radially outwards from the front end of the elongated recess. This is a particular user-friendly and reliable variant of detaching the lifting arm from the lifting unit, in particular from its lifting unit fixing pin.

The magnet may in particular be inserted into a recess of the pin and suitably fastened therein.

According to a second fixing variant of the lifting arm, the pharmacy formulation preparation device lifting arm is adapted for being fixed to a lifting unit of a pharmacy formulation preparation device for preparing an individual pharmaceutical product and for attaching a mixing vessel for such an individual pharmaceutical product thereto; and at the first longitudinal end of the basic body, in particular at the lower bearing region for a contact area of the lifting unit, an engagement recess is provided for an engagement element, in particular an engagement element on the lifting device-side, in particular an engagement ball on the lifting device side radially pretensioned by a spring, to engage in the engagement recess for fixing the basic body. This variant may in particular be provided in combination with the magnetic fixing variant.

This fixing variant using an engagement element and an engagement recess represents a fixing variant that is particularly easy to implement and also specifies a precisely defined position for the lifting arm and the lifting unit, in particular the lifting unit fixing pin thereof. This is in particular the position in which the stopping region of the first longitudinal end of the basic body abuts the front surface of the lifting unit and the bearing region of the lifting arm abuts the contact area of the lifting unit. By pretensioning the engagement ball by means of a spring, the engagement ball moves back when the lifting arm is slid onto the lifting unit, and then engages into the engagement recess when the engagement recess comes to rest in a position flush to the engagement ball.

In this engagement ball/engagement recess fixing variant, the lifting arm is slid onto the lifting unit fixing pin until the stopping region at the first longitudinal end of the basic body comes to rest on the front surface of the lifting unit. In this position, the engagement element, which was previously pressed against the spring, engages with the engagement recess. During detachment, the engagement element is accordingly pressed back against the spring, such that the last end of the lower side of the lifting arm can be moved over it in order to move the lifting arm off the lifting unit fixing pin.

According to one embodiment of this fixing variant, the engagement recess has the shape of a ball segment and/or the engagement recess is provided in the lower bearing region below the elongated recess.

According to a further variant of fixing the lifting arm with respect to the lifting unit, the pharmacy formulation preparation device lifting arm is adapted for being fixed to a lifting unit of a pharmacy formulation preparation device for preparing an individual pharmaceutical product in a clamping manner and for attaching a mixing vessel for such an individual pharmaceutical product thereto; and the basic body comprises a clamping lever recess extending between the elongated recess and an outer surface of the basic body arranged between the two longitudinal ends of the basic body, in particular laterally, wherein a clamping lever is arranged within the clamping lever recess, which lever can be moved between a non-clamping position and a clamping position, in which a clamping force can, through a clamping region thereof, be exerted onto a fixing pin inserted into the elongated recess.

Such fixing by means of a clamping lever is also user-friendly and intuitively operable. The lifting arm is first slid onto the lifting unit fixing pin all the way until the end position, in which the stopping region stops at the first longitudinal end of the basic body at the front surface of the lifting unit, and then the clamping lever is moved into its clamping position, in which it clamps the lifting arm with respect to the lifting unit fixing pin, thus fixing it.

In order to detach the lifting arm from the lifting unit, the clamping lever can be moved into its non-clamping position and then the lifting arm can be pulled off the lifting unit.

According to an embodiment of this fixing variant, the clamping lever can be pivoted about a stationary or rotational axis extending within the clamping lever recess from the upper side towards the lower side of the basic body, and/or the clamping lever comprises an actuation end facing away from the elongated recess and a clamping jaw facing towards the elongated recess, and/or the clamping lever is pivotable about the axis such that, in the non-clamping position, its clamping jaw rests outside the elongated recess and, in the clamping position, its clamping jaw protrudes into the elongated recess when the fixing pin is not inserted. Such a clamping lever has a simple and robust structure and is easily pivotable between its non-clamping position, or non-clamping positions, and its clamping position.

The basic body may, in the area of the clamping lever recess, have a reduced width, which may also be referred to as an indentation.

According to another fixing variant of the pharmacy formulation preparation device lifting arm according to the invention, the lifting arm is adapted for being fixed to a lifting unit of a pharmacy formulation preparation device for preparing an individual pharmaceutical product and for attaching a mixing vessel for such an individual pharmaceutical product thereto; and in the basic body, a screw opening having an inner thread is provided, which extends between the elongated recess and an outer side of the basic body, which is in particular positioned on the top or on the bottom. A clamping screw is inserted into the screw opening and can be screwed from a non-clamping position into a clamping position, in which a clamping force can, through its clamping screw end, be exerted onto a fixing pin inserted into the elongated recess.

Such a fixing by means of a clamping screw can also be performed and can easily intuitively and reliably be operated by a user. The lifting arm is in turn slid onto the lifting unit fixing pin until the stopping region comes to rest on the first longitudinal end of the basic body at the front surface of the lifting unit, then the clamping screw is screwed into the screw opening until the clamping force, exerted by its lower screw end onto the lifting unit fixing pin inserted into the elongated recess, fixes the lifting arm with respect to the lifting unit in a clamping manner. When loosening the clamping screw, the clamping screw is screwed out of the screw opening until the clamping force is no longer exerted, while the clamping screw is, however, still held within the screw opening, and then the lifting arm is pulled off the lifting unit fixing pin.

The invention also relates to a pharmacy formulation preparation device for preparing an individual pharmaceutical product, in particular individual pharmaceutical products such as ointments, semisolid preparations, pastes, creams, gels, emulsions, eye drops, lotions, pills, capsules or teas, comprises the following:

- a stand unit having a base region and a head region and a center region connecting the base region with the head region, the head region extending over the center region towards the front;
- a lifting unit arranged at the center region and being movable upwards and downwards, having a front surface extending in a substantially vertical direction, having a contact area extending in a substantially horizontal direction, in particular in a horizontal direction from the front surface towards the front; and having a lifting unit fixing pin protruding in a substantially horizontal direction towards the front, in particular from the front surface in a substantially horizontal direction towards the front, for sliding an exchangeable pharmacy formulation preparation device lifting arm thereon:
- an agitating unit arranged within or at the head region, which can be driven by a motor, and has an agitating stick extending from the head region downwards and having an agitating tool that is attached on or can be arranged to its lower end; and
- a control unit adapted such that the agitating unit can be driven by a motor and/or that the lifting unit with the lifting unit fixing pin can be displaced upwards and downwards.

The advantages and embodiments described above with reference to the lifting arm, as well as the findings and basic ideas underlying the invention, also apply to the inventive pharmacy formulation preparation device and are not repeated at this point. An inventive pharmacy formulation preparation device can be used and operated using different lifting arms with a variety of mixing vessels. "Arranged" herein means that the agitating tool is formed integrally with the agitating stick or is formed separately and attached to the agitating stick.

The agitating tool enters the mixing vessel from above. The front surface of the lifting unit forms a stopping region for the first longitudinal end of the basic body of the lifting arm and the contact area supports the bearing region of the lifting arm.

By replacing fixedly mounted lifting arms in existing pharmacy formulation preparation devices with an inventive lifting unit that can be moved upwards and downwards, it is also possible to provide existing devices with the ability to be employed in combination with a variety of different mixing vessels by using different lifting arms.

According to a first embodiment of the pharmacy formulation preparation device, the lifting unit fixing pin is arranged substantially in the center of the front surface and/or the distance between the lower end of the lifting unit fixing pin and the contact area is of equal size or slightly larger than the distance between the lower side of the elongated recess and the lower side of the basic body of the exchangeable lifting arm. This makes it possible to adjust the lifting unit especially well to the lifting arm or the lifting arms. The lifting arm or lifting arms can be slid onto the lifting unit with precision and be held thereby without tilting.

According to another embodiment of the device, the lifting unit further comprises an engagement element for engaging an engagement recess at the outer side of the basic body of the exchangeable lifting arm and for fixing it. Therefore, the inventive device can suitably interact with a lifting arm comprising an engagement recess arranged at the respective position of its lower side, such that such a lifting arm can easily be slid onto the lifting unit fixing pin by pushing away the engagement element, secured against sliding in the axial direction by the engagement element engaging the engagement recess on the lifting unit fixing pin and, after having been used, be pulled off the lifting unit fixing pin by pushing the engagement element away, in particular in a radial direction. Therefore, this is a fixing variant for the lifting arm that can be particularly easily manufactured and is at the same time very reliable.

According to another embodiment of the device, the engagement element is adapted as an engagement ball radially pretensioned towards the lifting unit fixing pin by means of a spring, which engagement ball is arranged within a recess of the supporting surface region of the lifting unit, and/or the spring is arranged below the engagement element and pushes the engagement element upwards.

Such pretensioning of the engagement element by means of a spring arranged and adapted as described above is particularly easy to realize and at the same time a very reliable way to pretension the engagement element towards the engagement recess for holding the lifting arm with respect to the lifting unit, and at the same time also allows for sliding on the lifting arm and pulling it off in an easy manner, while the engagement recess moves downwards.

According to another embodiment of the device, the supporting surface region is adapted as a protrusion protruding from the plane of the front surface towards the front and/or the recess is adapted as an opening extending through the supporting surface region in the vertical direction and/or the opening comprises at its lower end an inner thread and a screw, or a screw pin is screwed into the opening from below and the lower end of the spring abuts the screw or the screw pin.

In this embodiment, the protrusion is adapted like a ledge. The elements, viewed from top to bottom: engagement element, in particular engagement ball, spring and screw or screw pin, can be inserted easily and conveniently into the opening within the protrusion from below. The opening may on its upper side comprise a region having a reduced diameter to prevent the engagement element, in particular the engagement ball, from sliding therethrough upwards. As an alternative, a respective insert may be provided, which narrows the diameter of the opening on the upper side in order to prevent the engagement element, in particular the engagement ball, from sliding therethrough.

According to another embodiment of the device, the distance in the substantially horizontal direction between the front surface and the engagement element corresponds substantially to the distance between the first longitudinal end of the basic body of the exchangeable lifting arm and the engagement recess on the outside of the basic body. This ensures that both the engagement element and the engagement recess correspond to each other lengthwise. In other words, the engagement element engages the engagement recess when the stopping region comes to rest on the first longitudinal end of the basic body at the front surface of the lifting unit. This ensures a reliable fixing of the lifting arm in the final stopping position.

According to another embodiment of the device, the outer profile of the lifting unit fixing pin, in the case of a round outer profile of the lifting unit fixing pin, in particular the outer diameter of the lifting unit fixing pin, is of equal size or slightly smaller than the inner profile of the elongated recess, in the case of a round inner profile of the elongated recess, in particular the inner diameter of the elongated recess. Therefore, the outer profile of the lifting unit fixing pin and the inner profile of the elongated recess of the lifting arm correspond to each other, thereby ensuring a secure positioning of the lifting arm with respect to the lifting unit fixing pin in a radial direction and thus with respect to the entire lifting unit. A movement of the lifting arm in the radial direction, meaning in particular in the transverse direction with respect to the lifting unit fixing pin, is therefore completely prevented or minimized.

The invention also relates to an inventive device of the above-described type and an exchangeable lifting arm of the above-described type, which is slid, with its elongated recess, onto the lifting unit fixing pin such that the end of the lifting unit fixing pin is arranged shortly before the end of the elongated recess or rests against it; that the first longitudinal end of the basic body abuts the front surface of the lifting unit, and that the bearing region of the basic body rests on the contact area of the lifting unit.

In other words, the present invention also relates to a combination of a pharmacy formulation preparation device and a pharmacy formulation preparation device lifting arm. By correspondingly adapting the stopping region at the first longitudinal end of the basic body and the front surface of the lifting unit, the bearing region on the lower side of the basic body of the lifting arm and the contact area of the lifting unit, and the elongated recess on the lifting arm side and the lifting unit fixing pin on the lifting unit side, the lifting arm can be securely and precisely arranged at the lifting unit. This reliably prevents the lifting arm from sliding into a transverse direction and thus from tilting about the axis formed by the lifting unit fixing pin, and from moving backwards.

In order to also prevent the lifting arm from sliding towards the front, the lifting arm may in addition be fixed to the lifting unit, as explained above with reference to the lifting arm and with reference to the lifting unit.

In a combination of the device and the lifting arm, the lifting arm is, in the magnetic fixing variant, fixed to the lifting unit such that the pharmacy formulation preparation device lifting arm is magnetically fixed to the lifting unit by having the magnet of the pin arranged in the position of magnetic attraction at the front end of the elongated recess of the basic body and fixing the pharmacy formulation preparation device lifting arm with respect to the lifting unit fixing pin.

In the fixing variant by means of engagement, the lifting arm is fixed to the lifting unit of the pharmacy formulation preparation device by having the engagement element on the lifting unit side engage the engagement recess at the first longitudinal end of the basic body.

In the fixing variant by means of clamping lever, the lifting arm is fixed to the lifting unit of the pharmacy formulation preparation device in a clamping manner by having the clamping lever positioned in the clamping position, in which a clamping force is, through its clamping region, exerted onto the lifting unit fixing pin.

In the fixing variant by means of a clamping screw, the lifting arm is fixed to the lifting unit of the pharmacy formulation preparation device in a clamping manner by having the clamping screw positioned in the clamping position, in which, through its clamping screw end, a clamping force is exerted onto the fixing pin inserted into the elongated recess.

In all fixing variants, the lifting arm can be reliably fixed with respect to the lifting unit in all spatial directions, at the same time allowing for easily sliding the lifting arm onto the lifting unit fixing pin and allowing for easily pulling the lifting arm off the lifting unit fixing pin.

BRIEF DESCRIPTION OF THE DRAWINGS

In the following, the invention is explained in greater detail by means of exemplary embodiments with reference to the accompanying drawings.

DETAILED DESCRIPTION

Figure 1:
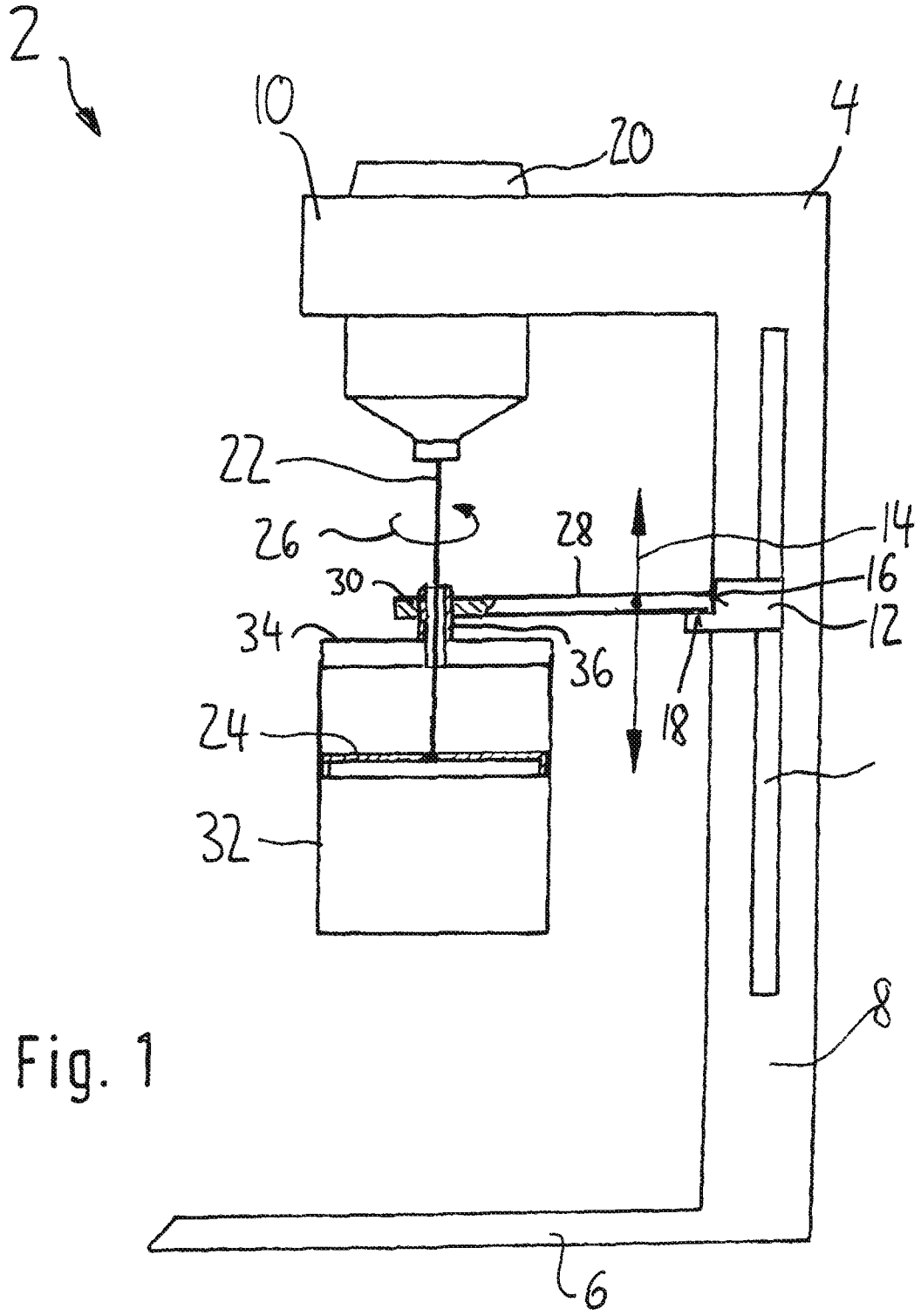
FIG. 1 shows a schematic side view of a pharmacy formulation preparation device comprising a lifting arm arranged on a lifting unit of the same having a mixing vessel fixed to its front side and having an agitating unit with an agitating stick and an agitating tool arranged on its head region according to an exemplary embodiment of the invention.

FIG. 1 shows a schematic side view of a pharmacy formulation preparation device 2 comprising a lifting arm 28 arranged on a lifting unit 12 of the pharmacy formulation preparation device 2 having a mixing vessel 32 fixed to its front side and an agitating unit 20 having an agitating stick 22 and an agitating tool 24 arranged at the head region 10 thereof.

The pharmacy formulation preparation device 2 comprises a stand unit 4 having a base region 6, a center region 8 and a head region 10. The center region 8 extends in the vertical direction between the rear end of the base region 6 and the rear end of the head region 10, and the base region 6 and the head region 10 extend, with respect to the center region 8, towards the front. Accordingly, a workspace is enclosed by the base region 6, the center region 8 and the head region 10.

A portion of the head region 10 arranged between the middle and the front of the head region 10 has an agitating unit 20 attached thereto, comprising an agitating stick 22 extending vertically downwards therefrom and having an agitating tool 24 attached or arranged on its lower end, the agitating tool 24 entering a mixing vessel 32 through a fastening extension 36 and a lid plate 34. The mixing vessel 32 having the fastening extension 36 is held by the lifting arm 28 described below. The agitating unit 20 comprises an electric motor adapted such as to be able to move the agitating stick 22 and the agitating tool 24 in the rotational direction 26, which is illustrated with an arrow.

A lifting unit 12 is arranged at the center region 8 and can be moved up and down by means of an electric motor, not shown, in the vertical lifting direction 14.

Alternatively, the electric motor may also be omitted. In this case, the lifting unit 12 serves as a guiding element for the mixing vessel 32 attached to the lifting arm 28, wherein the mixing vessel 32, the lifting arm 28 and the lifting unit 12 are movable upwards and downwards manually by a user in the vertical direction along the center region 8.

The extent of the vertical lifting direction 14 depends on the height of the inner volume of the respective mixing vessel 32 attached to the lifting arm 28. Preferably, the lifting unit 12 may be movable between an upper position directly beneath the lower end of the upper agitating unit 22 and a lower shifting position, which is located above the base region 6 at a sufficient height for the mixing vessel 32 to still fit between a lifting arm attached to the lifting unit 12 and the upper end of the base region 6.

The lifting unit 12 comprises a vertical front surface 16 facing towards the front and a horizontal supporting surface 18 arranged beneath the same and protruding from the plane of the vertical front surface 16 towards the front. The lifting unit 12 also comprises a lifting unit fixing pin (not shown in FIG. 1), onto which the lifting arm 28 may be slid with its elongated recess (also not shown in FIG. 1).

The lifting arm 28 has a substantially elongated basic body having a first rear longitudinal end and a second front longitudinal end on the opposite side.

The elongated recess of the lifting arm 28 that cannot be seen in FIG. 1 extends from the first longitudinal end of the basic body over part of the longitudinal direction of the basic body towards the opposing second longitudinal end, and the length of this elongated recess corresponds to the length of the lifting unit fixing pin or is slightly longer.

The vertically aligned first longitudinal end of the basic body forms a stopping region for the front surface 16 of the lifting unit 12 and the lower end of the lower side of the basic body of the lifting arm 28 facing the first longitudinal end of the lifting arm 28 forms a bearing region for the supporting surface 18 of the lifting unit 12.

In FIG. 1, the lifting arm 28 is, with its elongated recess, longitudinally slid onto the lifting unit fixing pin of the lifting unit 12 and rests, with its bearing region, on the supporting surface 18 of the lifting unit 12 and comes to rest with its stopping region on the front surface 16 of the lifting unit 12.

At or close to the second longitudinal end of the basic body of the lifting arm 28, a mixing vessel fastening unit 30 is arranged, which may be adapted in any suitable way desired. A variant of adapting the mixing vessel fastening unit 30 is to provide it with at least one threaded section corresponding to at least one corresponding threaded section of the fastening extension 36 of the mixing vessel 32. Alternative designs of the mixing vessel fastening unit 30 comprise click mechanisms or latch mechanisms, bayonet mechanisms, hooking mechanisms or the like.

The mixing vessel 32 has a circular-cylindrical jacket without a neck or being narrowed in any other way on its upper end, such that, before preparing an individual pharmaceutical product, the components for preparing the individual pharmaceutical product can be easily added to the mixing vessel 32 and the individual pharmaceutical product prepared in the mixing vessel 32 can be completely removed by means of a spatula, for example. Furthermore, the cylindrical basic body allows for the agitating tool to reach the entire interior space of the pharmacy formulation preparation crock 31, thereby allowing for grinding or mixing even very small agglomerates of active ingredients.

The mixing vessel 32 comprises a lid plate 34 which can be screwed onto the circular-cylindrical jacket by means of a thread, for example. The lid plate 34 has a substantially centered through-opening as well as a substantially circular-cylinder-shaped fastening extension extending from the through-opening upwards. The fastening extension 36 is provided with fastening means corresponding to the mixing vessel fastening unit 30, meaning to at least one threaded section with a click mechanism or latch mechanism, bayonet mechanism, hooking mechanism or the like, for example.

During operation of the inventive pharmacy formulation preparation device 2, the components for the individual pharmaceutical product to be prepared are first added to the mixing vessel 32. Afterwards, the agitating tool 24, which is connected to or arranged with the agitating stick 22, is inserted into the mixing vessel 32 and may rest on top of the ingredients or be immersed therein. Next, the agitating stick 22, which is not yet connected to the agitating unit 20, is guided through the fastening extension 36 of the lid plate 34 and the lid plate 34 is guided up to the mixing vessel 32 and is borne thereon or screwed thereto or attached thereto in any other suitable manner. Then the lifting arm 28, comprising a mixing vessel fastening unit 30 corresponding to the fastening extension 36, is arranged on the lifting unit 12. The entire arrangement consisting of mixing vessel 32, lid plate 34, agitating stick 22 and agitating tool 24 is then attached to the mixing vessel fastening unit 30 of the lifting arm 28 and the lifting unit 12 having the lifting arm 28, and the mixing vessel 32 with the lid plate 34 and the fastening extension 36 attached thereto is moved upwards until the agitating stick 22 can snap into the agitating unit 20. Now, the production of the individual pharmaceutical product can start.

Figure 2:
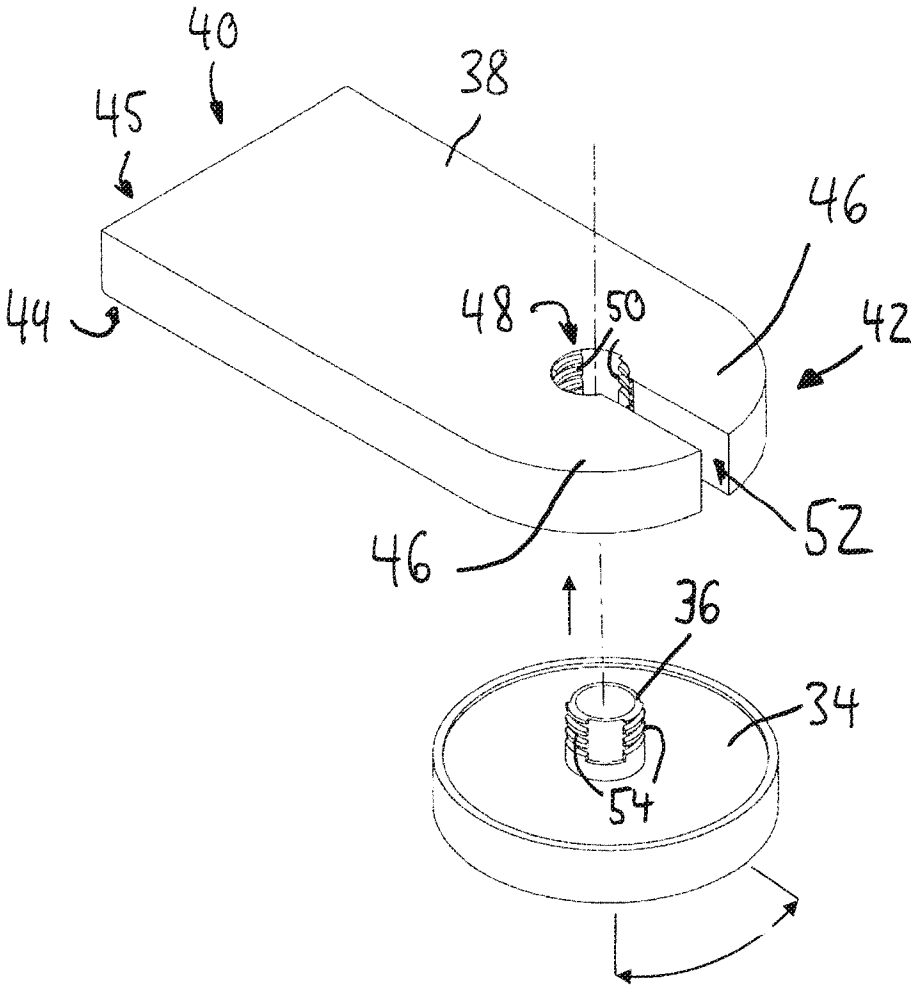
FIG. 2 shows a perspective enlarged view of the lifting arm according to FIG. 1 and the lid plate to be fixed thereto with its fastening extension according to another exemplary embodiment of the invention.

FIG. 2 shows a perspective view of the lifting arm 28 and the lid plate 34 with the fastening extension 36 to be fixed thereto.

The lifting arm 28 shown in FIG. 2 has an elongated basic body 38 having a substantially cuboid flat basic shape and comprising a first rear longitudinal end 40 and a second front longitudinal end 42 having claw extensions 46 with a rounded outer shape, which form a mixing vessel fastening extension fastening region 48 located on the longitudinal center axis and an agitating stick insertion region 52 arranged in front of it. This is especially advantageous because the agitating stick 22 protruding from the mixing vessel 32 does not have to be guided through the mixing vessel fastening extension fastening region 48 from below. This prevents the mixing vessel fastening extension fastening region 48 from being damaged by carelessly passing the agitating stick 22 therethrough.

The vertical front surface of the first longitudinal end 40 forms a first stopping region 45 and the end section of the lower side of the lifting arm 28 located at the first longitudinal end 40 forms a bearing region 44.

The mixing vessel fastening extension fastening region 48 comprises, in the present exemplary embodiment, a plurality of, in particular three, inner thread regions spaced apart from one another in the circumferential direction and corresponding to the three outer thread regions 54 of the fastening extension 36 of lid plate 34, which are also arranged spaced apart from one another. The thread regions 50 on the lifting arm side and the outer thread regions 54 on the lid plate fastening extension side and the threadless intermediate regions therebetween are matched to each other in a way that the fastening extension 36 can be inserted from below into the mixing vessel fastening extension fastening region 48 in a rotary position, in which the outer thread regions 54 on the lid plate fastening extension-side are positioned at the circumferential positions corresponding to the threadless regions of the mixing vessel fastening extension fastening region 48.

In an exemplary embodiment not shown, an screw-in limiting region is arranged, viewed in vertical direction, at the upper end of the upper substantially cylindrical recess region of the mixing vessel fastening extension fastening region, the screw-in limiting region having a smaller diameter than the mixing vessel fastening extension fastening region and forming an screw-in limiting surface facing downwards, on which a stopper surface of a fastening extension of the lid plate stops as soon as the lid plate is in its fixing position.

After having been inserted from below, the lid plate 34 can now be screwed into the mixing vessel fastening unit 30 such that the outer thread regions 54 on the lid plate fastening extension side engage the thread regions 50 on the lifting arm side and thus attach the lid plate 34 with respect to the lifting arm 28.

In the lifting arm 28, the second longitudinal end 42 of which is provided with claw extensions 46 and an agitating stick insertion region 52 positioned between these claw extensions 46, the agitating stick 22 protruding from the mixing vessel 32 through the lid plate 34 may alternatively be slid into the mixing vessel fastening extension fastening region 48 from the front through the agitating stick insertion region 52, if it is wide enough. Afterwards, the fastening extension 36 can be made to abut the mixing vessel fastening extension fastening region 48 through a slight lifting of the mixing vessel 32 and then be fixed by screwing it in.

The mixing vessel fastening extension fastening region 48 has a substantially cylindrical shape and the agitating stick insertion region 52 may form a substantially cuboid space.

The sliding direction of the lid plate 34 with the fastening extension 36 from below into the mixing vessel fastening extension fastening region 48 is shown in FIG. 2 with a vertical arrow. The rotational direction for moving the thread regions 50 and 54 into the engaging fastening position and back is shown in FIG. 2 with a double arrow.

Figure 3:
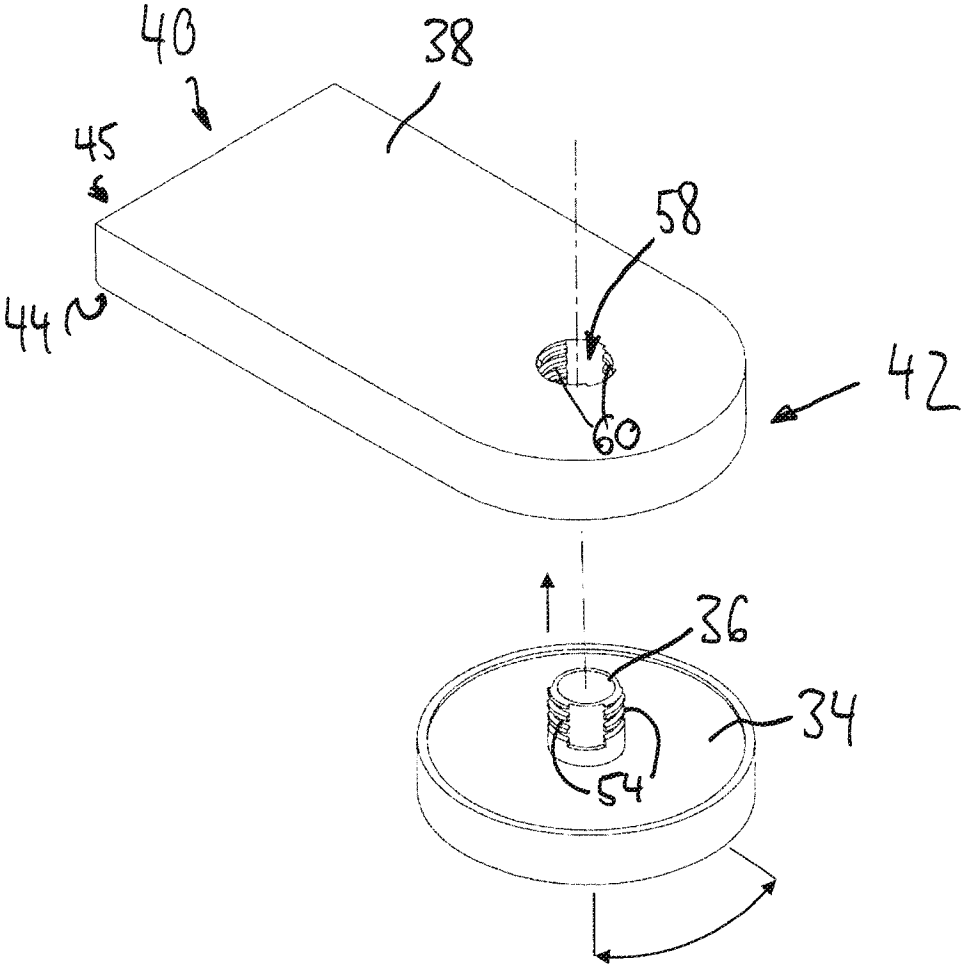
FIG. 3 shows a schematic perspective view of a second lifting arm and a lid plate to be fixed thereto with its fastening extension according to another exemplary embodiment of the invention.

FIG. 3 shows a schematic perspective view of a second lifting arm 56 and a lid plate 34 with a fastening extension 36 to be fixed thereto.

The second lifting arm 56 corresponds to the first lifting arm 28, without an agitating stick insertion region 52 being provided and with the mixing vessel fastening extension fastening region 58 being adapted as a substantially cylindrical through-opening extending from bottom to top through the basic body 38 of the second lifting arm 56. The same elements are referred to with the same reference signs as in FIG. 2 and will not be explained again to avoid repetitions.

The mixing vessel fastening extension fastening region 58 is, in turn, adapted such as to comprise a plurality of, in the present exemplary embodiment three, thread extensions 60 spaced apart from one another in the circumferential direction and threadless sections arranged therebetween. Inserting and fixing the lid plate 34 to the fastening extension 36 within the mixing vessel fastening extension fastening region 58 is performed as described with reference to FIG. 2, however without insertion from the front.

Figure 4:
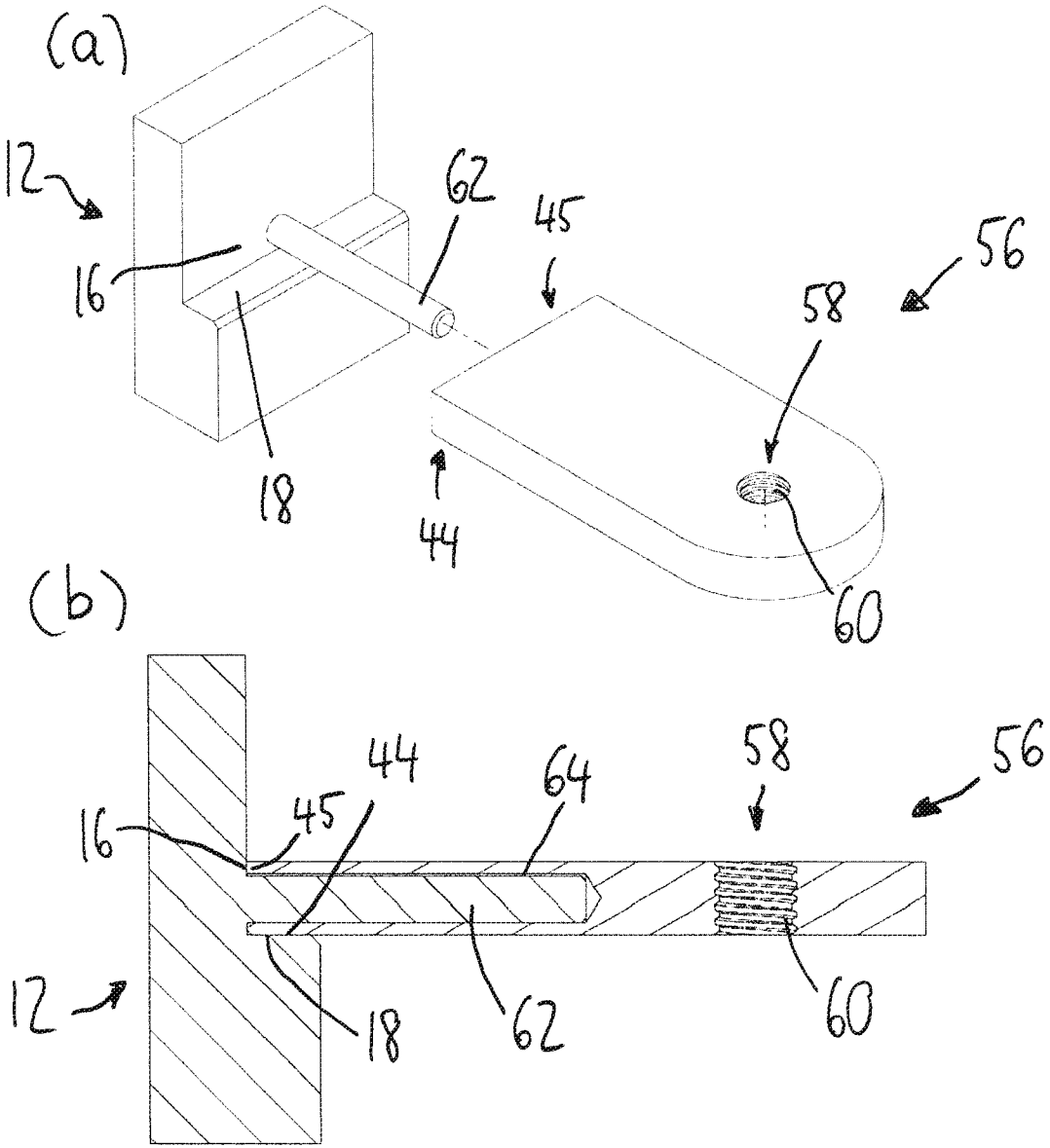
FIG. 4 shows in partial FIG. 4(*a*) a schematic perspective view of the second lifting arm according to FIG. 3 and the lifting unit according to FIG. 1 in a position prior to sliding the second lifting arm onto the lifting unit fixing pin of the lifting unit; and in partial FIG. 4(*b*), a sectional view of the second lifting arm and the lifting unit in the inserted position of the lifting arm on the lifting unit according to another exemplary embodiment of the invention.

FIG. 4 shows in partial FIG. 4(*a*) a schematic perspective view of the second lifting arm 56 and the lifting unit 12 in a position prior to sliding the second lifting arm 56 onto the lifting unit fixing pin 62 of the lifting unit 12; and in partial FIG. 4(*b*), a sectional view of the second lifting arm 56 and the lifting unit 12 in the inserted position of the lifting arm 56 on the lifting unit 12.

In the lifting unit 12, the lifting unit fixing pin 62 is now clearly shown protruding in the horizontal direction towards the front from the vertical front surface 16. It can also be seen that the lifting unit 12 comprises a ledge-like front side having a vertical front surface 16 in the upper section and an enlarged lower section, the upper side of which is formed by the horizontal supporting surface 18.

The front end of the horizontal supporting surface 18 is rounded off or slanted towards the front side of the enlarged lower section of the lifting unit 12, which facilitates the sliding of the second lifting arm 56 and prevents it from getting stuck.

At the front end of the lifting unit fixing pin 62, the circumferential front edge is also rounded off or slanted.

In FIG. 4(*b*), the elongated recess 64 extending from the rear longitudinal end of the lifting arm 56 towards the opposing front end of the same is clearly shown. The depth of this elongated recess 64 corresponds to approximately half the length of the lifting arm 56. It is understood that other depths are also possible. The front bottom of the elongated recess 64 is rounded off.

In addition, it is also clearly shown in FIG. 4(*b*) that the length of the lifting unit fixing pin 62 and the depth of the elongated recess 64 correspond to one another. In the present exemplary embodiment, the length of the lifting unit fixing pin 62 is approximately the same size as the depth of the elongated recess 64.

In the exemplary embodiment according to FIG. 4, the fastening unit is adapted as a continuous inner thread 60 within the substantially cylindrical fastening extension fastening region 58.

It is easy to imagine the process of sliding the lifting arm 56 onto the lifting unit 12 from the position shown in FIG. 4(*a*) into the inserted position shown in FIG. 4(*b*), which may also be referred to as stopping position.

First, the lifting arm 56 is aligned horizontally and is slid with its elongated recess 64 onto the lifting unit fixing pin 62 from the front until its stopping region 45 comes to rest on the front surface 16 and its bearing region 44 comes to rest on the horizontal supporting surface 18. Next, a mixing vessel can be attached, in particular screwed, to the fastening extension fastening region 58 with its fastening extension. Detaching the mixing vessel and pulling the lifting arm 56 off can be performed analogously.

Figure 5:
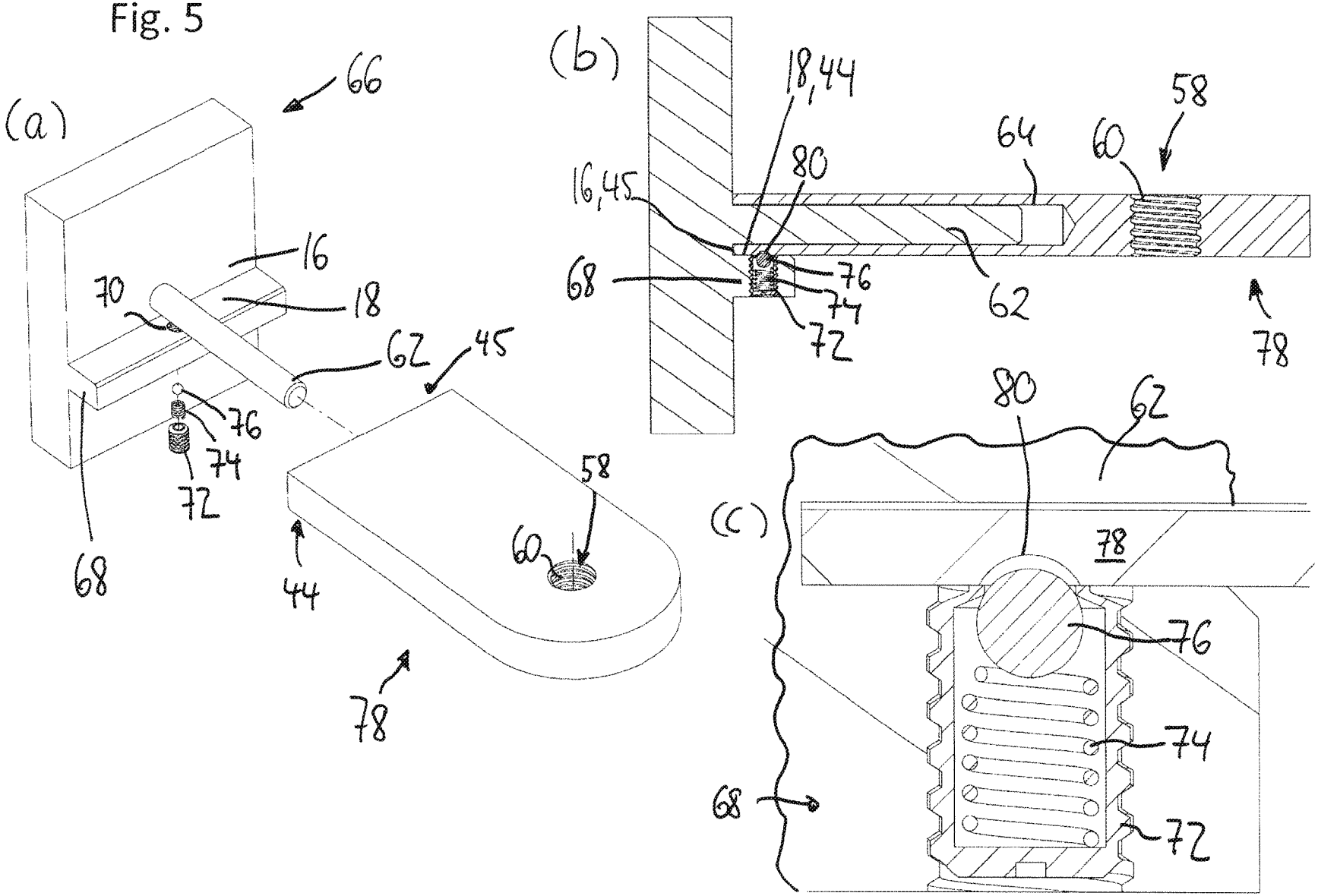
FIG. 5 shows in partial FIG. 5(*a*) a schematic perspective view of a third lifting arm and a second lifting unit in a position prior to sliding the lifting arm onto the lifting unit; and in partial FIG. 5(*b*), a sectional view of the lifting arm and the lifting unit in the fixed state of the lifting arm; and in partial FIG. 5(*c*), an enlarged illustration of the cutaway of the lower bearing region of the lifting arm and the engagement ball lifting unit side arranged thereunder with the screw pin and spring according to another exemplary embodiment of the invention.

FIG. 5 shows in partial FIG. 5(*a*) a schematic perspective view of a third lifting arm 78 and a second lifting unit 66 in a position prior to sliding the lifting arm 78 onto the lifting unit 66; and in partial FIG. 5(*b*), a sectional view of the lifting arm 78 and the lifting unit 66 in the fixing position of the lifting arm 78; and in partial FIG. 5(*c*), an enlarged illustration of the cutaway of the lower bearing region of the lifting arm 78 and the engagement ball 76 on the lifting unit side arranged thereunder having the screw pin 72 and spring 74.

The arrangement of the second lifting unit 66 corresponds, with respect to the arrangement of the vertical front surface 16 and the horizontal supporting surface 18 and the arrangement of the lifting unit fixing pin 62, to the lifting unit 12, and the same elements are referred to with the same reference signs.

In FIG. 5(*b*), it can also be seen that the depth of the elongated recess 64 is longer than the length of the lifting unit fixing pin 62.

Instead of having a ledge-like lower section having a constant width, as in the first lifting unit 12, the horizontal supporting surface 18 is, in the lifting unit 66, arranged on top of a ledge-like protrusion 68, which also comprises an opening 70 below the lifting unit fixing pin 62, provided at least partially with an inner thread shown in FIGS. 5(*b*) and 5(*c*).

A threaded pin 72, a spring 74 and an engagement ball 76 are inserted into this opening 70 from below. As is clearly shown in FIG. 5(*c*), the threaded pin 72 is provided with an outer thread and forms an inner substantially cylindrical receiving space having an opening on its upper side. In this receiving space, the spring 74 and the engagement ball 76 are arranged such that the spring 74 pretensions the engagement ball 76 upwards such that the engagement ball 76 protrudes from the upper opening.

In FIG. 5(*c*), it is clearly shown that the threaded pin 72 is screwed into the opening 70 of the ledge-like protrusion 68 from below to an extent that the upper side of the threaded pin 72 is located on the plane of the horizontal supporting surface 18 and that the engagement ball 76 protrudes upwards from this plane.

In the center of the lower bearing region 44 of the lifting arm 78 and in a longitudinal position, which corresponds to the position of the engagement ball 76 on the lifting unit side, an engagement recess, in particular a rounded engagement recess 80, is provided, which the engagement ball 76 can engage with in order to fix the lifting arm with respect to the lifting unit 12.

When sliding the lifting arm 78 onto the lifting unit fixing pin 62 from the front, the engagement ball 76 is pressed from the lower edge of the first longitudinal end of the basic body downwards against the acting direction of the spring 74 until the engagement recess 80 comes to rest above the engagement ball 76. Then, the engagement ball 76 snaps into the engagement recess 80 and thus provides for an additional position-secured fixing of the lifting arm 78, in particular so it does not slide away towards the front.

Figure 6:
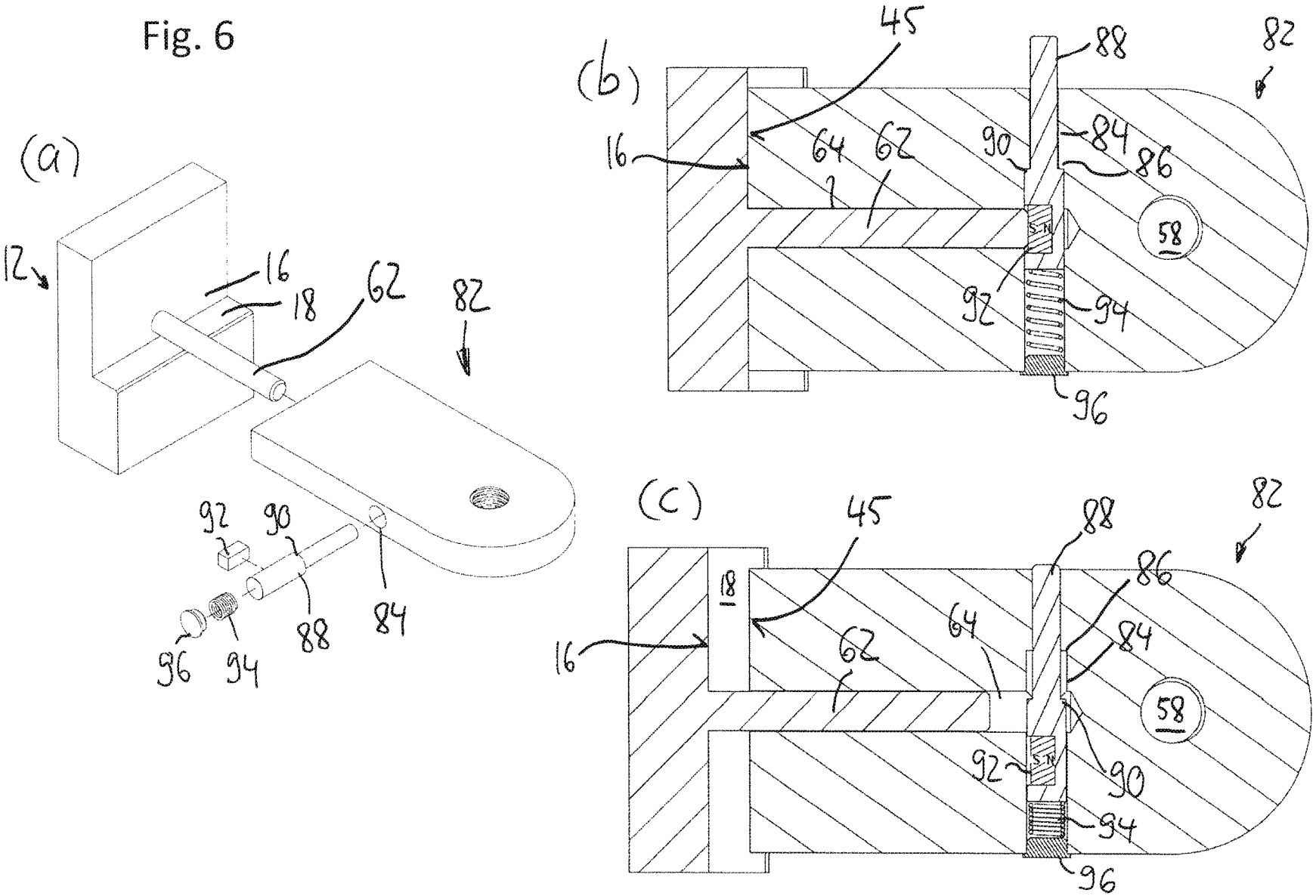
FIG. 6 shows in partial FIG. 6(*a*) a schematic perspective view of a fourth lifting arm having a magnetic pin and the lifting unit according to FIG. 1 in a position prior to sliding the lifting arm onto the lifting unit fixing pin; and in its partial FIG. 6(*b*), a horizontal sectional view of the lifting arm and the lifting unit in the fixing position of the lifting arm on the lifting unit with the magnetic pin in the position of magnetic attraction; and in partial FIG. 6(*c*), a horizontal sectional view of the lifting arm and the lifting unit in a position shortly after detachment from the fixing position with the magnetic pin in a release position according to another exemplary embodiment of the invention.

FIG. 6 shows in partial FIG. 6(*a*) a schematic perspective view of a fourth lifting arm 82 having a magnetic pin 88 and the lifting unit 12 according to FIG. 1 in a position prior to sliding the lifting arm 82 onto the lifting unit fixing pin 62; and in partial FIG. 6(*b*), a horizontal sectional view of the lifting arm 82 and the lifting unit 12 in the fixing position of the lifting arm 82 on the lifting unit with the magnetic pin 88 in the position of magnetic attraction; and in partial FIG. 6(*c*), a horizontal sectional view of the lifting arm 82 and the lifting unit 12 in a position shortly after detachment from the fixing position with the magnetic pin 88 in a release position.

The lifting unit 12 corresponds to the lifting unit 12 explained and illustrated in FIG. 4. The same elements are referred to with the same reference signs. The fourth lifting arm 82 principally corresponds to the lifting arm 56 according to FIG. 3 and the same elements are referred to with the same reference signs.

In addition, the fourth lifting arm 82 has a magnetic pin opening 84 extending diagonally through its basic body, which opening 84 is connected to the elongated recess 64. The magnetic pin opening 84 has, as is clearly shown in FIGS. 6(*b*) and 6(*c*), a first section having a smaller diameter and a second section having a larger diameter, with an annular stopper 86 formed at their transition. In the exemplary embodiment according to FIGS. 6(*b*) and 6(*c*), the second section having a larger diameter takes up approximately two-thirds of the width of the basic body of the fourth lifting arm 82 and the first section having a smaller diameter correspondently takes up approximately one-third of the width.

This magnetic pin opening 84 has, from the one side to the other, in particular from right to left, a pin 88 having a magnet 92, which is also referred to as magnetic pin, a spring 94, and a closing cap 96 inserted therein.

The pin 88 has a first section having a smaller diameter and a second section having a larger diameter, with an annular step 90 formed at their transition, which can hit the annular stopper 86.

The length of the first section having a smaller diameter is slightly longer than the width of the first section, having a smaller diameter, of the magnetic pin opening 84, such that, in the release position according to FIG. 6(*b*), the end of the pin 88 protrudes from the first section, having a smaller diameter, of the magnetic pin opening 84.

The length of the second section, having a larger diameter, of the pin 88 is dimensioned such that, in the position of magnetic attraction, according to FIG. 6(*b*), this length plus the length of the spring 94 in the position pressing the pin 88 with its annular step 90 against the annular stopper 86 plus the length of the closing cap 96 correspond to the width of the second section, having a larger diameter, of the magnetic pin opening 84.

The closing cap 96 fixes the end of the spring 94 facing the closing gap 96, and thus the entire spring 94 and the entire pin 88, with respect to the basic body of the fourth lifting arm 82 and may be connected thereto by clamping, plugging or in any other way.

In the second section, having a larger diameter, of the pin 88, a recess or groove is provided, having a magnet, in particular a permanent magnet 92, inserted therein.

This magnet 92 is arranged such that it is, in the position of magnetic attraction according to FIG. 6(*b*), flush with respect to the lifting unit fixing pin 92, meaning it comes to rest as an extension of the elongated recess 64. In the exemplary embodiment according to FIGS. 6(*b*) and 6(*c*), its south pole faces the lifting unit fixing pin 62 and its north pole faces away from the lifting unit fixing pin 62. In the position of magnetic attraction according to FIG. 6(*b*), the spring 94 presses the pin 88 such that the annular step 90 comes to rest on the annular stopper 86, so that the magnet 92 is arranged in its position of magnetic attraction at the front end of the elongated recess 94 of the basic body and that the end region of the first section, having a smaller diameter, of the pin 88 protrudes from the magnetic pin opening. In this position, an attraction force acts between the magnet 92 and the front end of the lifting unit fixing pin 62 and the lifting arm 82 is therefore fixed reliably to the lifting unit 12 and is in particular secured against sliding out towards the front.

According to FIG. 6(*c*), the end region of the first section, having a smaller diameter, of the pin 88 has been pressed by a user into the magnetic pin opening 84 to an extent that the end region of the pin 88 is substantially positioned in the plane of the right outer surface of the basic body. In this position, the magnet 62 and, together with it, the pin 88 have been moved into the release position, in which the magnet 92 has been displaced radially outwards from the front end of the elongated recess 64.

In this release position, there is no or only a slight magnetic attraction between the magnet 92 and the front end of the lifting unit fixing pin 62. Accordingly, the lifting arm 82 can, after the pin 88 has been moved into this release position, easily be pulled off the lifting unit fixing pin 62 towards the front.

In the attaching variant shown in FIG. 6 using the magnetic pin 88, it is preferable that the basic body of the lifting arm 82 is made of a non-magnetic, in particular non-ferromagnetic material, such as a plastic or aluminum, whereas at least the front end of the lifting unit fixing pin 62, in particular the entire lifting unit fixing pin 62, comprises a ferromagnetic material.

In a further (not shown) exemplary embodiment, the front end of the lifting unit fixing pin comprises a borehole in the axial direction. This borehole may have a ferromagnetic material, in particular a ferromagnetic screw, arranged or fastened thereto. This is a particularly cost-efficient alternative. The lifting unit fixing pin does then not have to completely comprise a ferromagnetic material.

Figure 7:
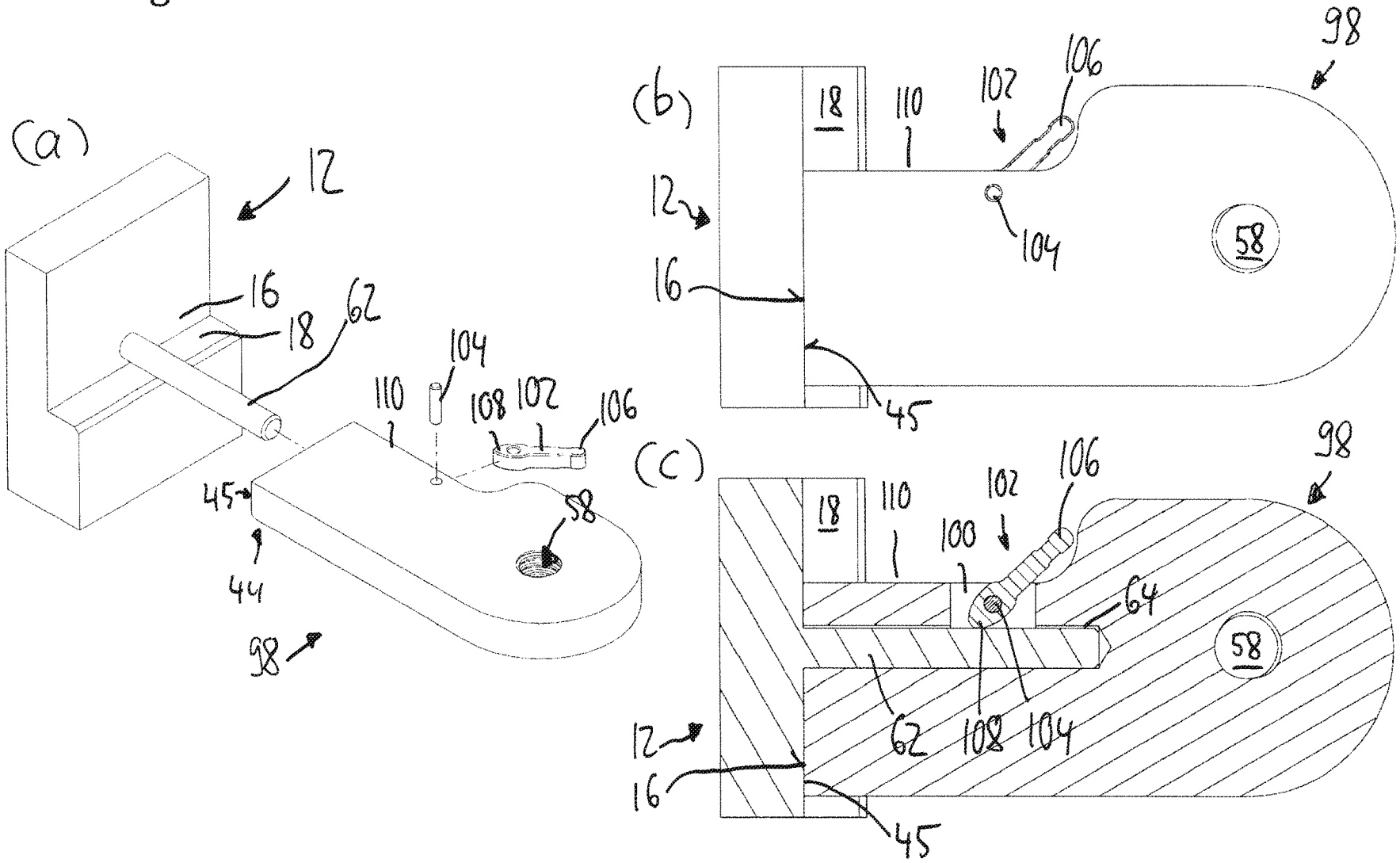
FIG. 7 shows in partial FIG. 7(*a*) a schematic perspective view of a fifth lifting arm and the lifting unit according to FIG. 1 in a position prior to sliding the second lifting arm onto the lifting unit fixing pin; and in partial FIG. 7(*b*), a plan view of the lifting arm and the lifting unit in the fixing position of the lifting arm; and in partial FIG. 7(*c*), a horizontal sectional view of the lifting arm and the lifting unit in the lifting arm fixing position according to another exemplary embodiment of the invention.

FIG. 7 shows in partial FIG. 7(*a*) a schematic perspective view of a fifth lifting arm 98 and the lifting unit 12 in a position prior to sliding the lifting arm 98 onto the lifting unit fixing pin 62; and in partial FIG. 7(*b*), a plan view of the lifting arm 98 and the lifting unit 12 in the fixing position of the lifting arm; and in partial FIG. 7(*c*), a horizontal sectional view of the lifting arm 98 and the lifting unit 12 in the lifting arm fixing position.

The lifting unit 12 according to FIG. 7 corresponds to the lifting unit 12 according to FIGS. 4 and 6. The same elements are referred to with the same reference signs and are not explained again.

The fifth lifting arm 98 corresponds to the second lifting arm 56 according to FIG. 3 except for the following differences, wherein the same elements are referred to with the same reference signs and are not explained again.

In the rear region on the right side, the basic body of the fifth lifting arm 98 has a region 110 decreased in width and in this region 110 decreased in width, a clamping lever recess 100 is provided extending between the elongated recess 64 and towards the right outer side of the basic body at the height of the elongated recess 64. This clamping lever recess 100 has a clamping lever 102 arranged therein, which can be pivoted about an axis 104 between a non-clamping position explained below and a clamping position explained below. The axis 104 extends in the vertical direction through this clamping lever recess 100 and is suitably mounted or attached in the basic body sections above and below the clamping lever recess 100 in a pivotable manner and is suitably secured against sliding out upwards or downwards or laterally.

The clamping lever 102 comprises an actuation end 106, protruding outwards from the clamping lever recess 100 and from the plane of the right outer side of the region 110 decreased in width, and a clamping jaw 108 cooperating with the lifting unit fixing pin 62.

In FIGS. 7(*b*) and 7(*c*), the clamping lever 102 is pivoted with its actuation end 106 towards the second longitudinal front end of the basic body of the lifting arm 98, such that its clamping jaw 108 rests with its clamping end in the extension of the inner surface of the elongated recess. In this non-clamping position, the lifting arm 98 can be slid onto the lifting unit fixing pin 92 with its elongated recess 94 until the lifting arm comes to rest at its stopping region 45 on the vertical front surface 16 and with its bearing region 44 on the horizontal supporting surface 18. This position is shown in FIGS. 7(*b*) and 7(*c*).

In order to bring the clamping lever 102 and at the same time the entire lifting arm 98 into the clamping position, the clamping lever 102 is now pivoted, such that the clamping lever 102 is pivoted in the transverse direction, meaning with its actuation end 106 backwards in the present exemplary embodiment, thereby exerting a clamping force onto the lifting unit fixing pin 82 through the clamping jaw 108. In this clamping position, the lifting arm 98 is fixed in a securely clamping manner, in particular to prevent the lifting arm 98 from sliding out towards the front.

In order to release the lifting arm 98 from the lifting unit 12, the clamping lever is pivoted from the clamping position into the non-clamping position.

As an alternative, the clamping lever 102 may, for a non-clamping position, also be pivoted with its actuation end 106 all the way to the back, and the clamping position may be reached by pivoting the clamping lever 102 with its actuation end 106 towards the front, whereby the clamping jaw 108, in turn, exerts a clamping force onto the lifting unit fixing pin 62.

Figure 8:
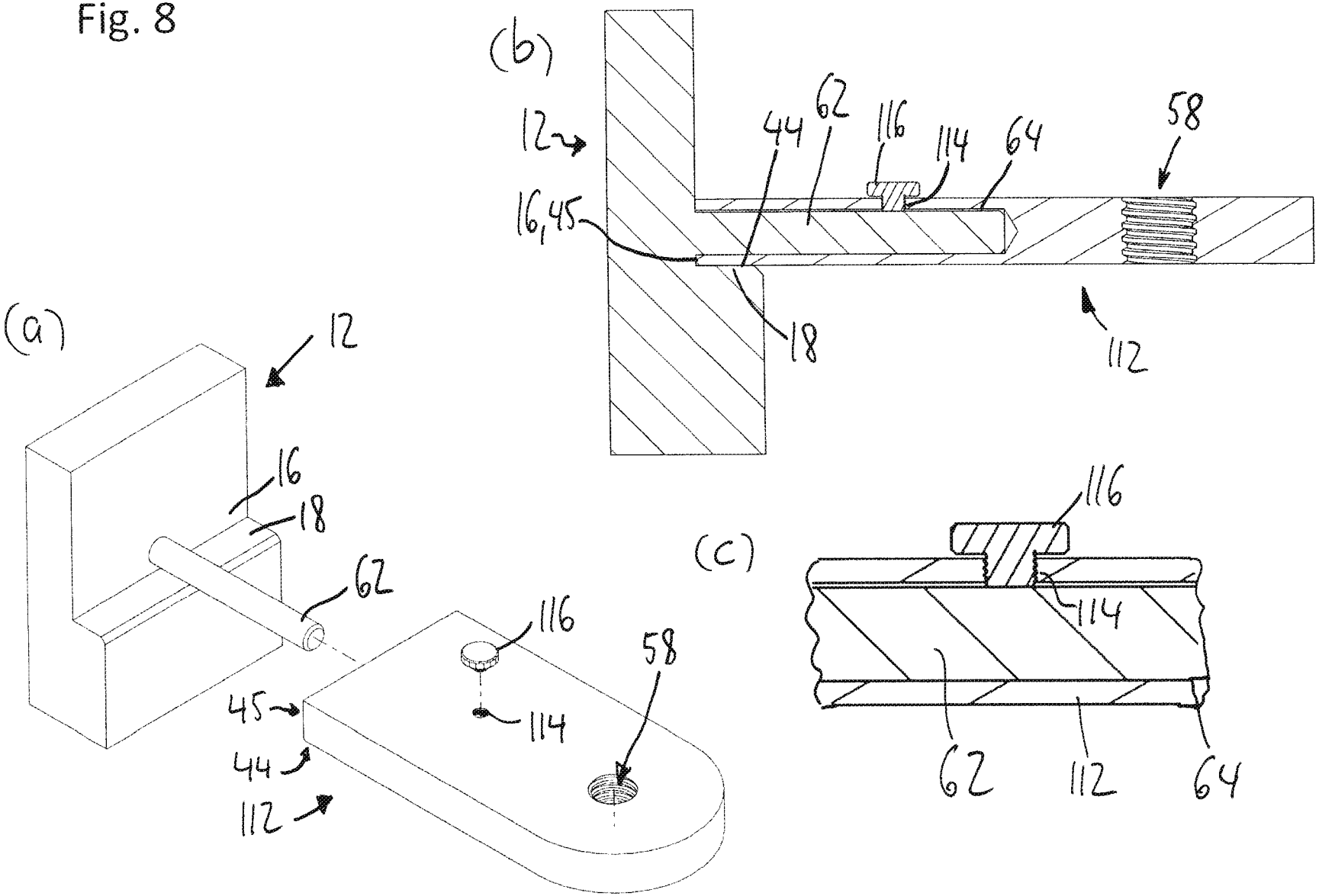
FIG. 8 shows in partial FIG. 8(*a*) a schematic perspective view of a sixth lifting arm and the lifting unit according to FIG. 1 in a position prior to sliding the second lifting arm onto the lifting unit fixing pin; and in partial FIG. 8(*b*), a vertical sectional view of the sixth lifting arm and the lifting unit in the fixing position of the lifting arm; and in partial FIG. 8(*c*), an enlarged sectional view of the cutaway of FIG. 8(*b*) with the clamping screw according to another exemplary embodiment of the invention.

FIG. 8 shows in partial FIG. 8(*a*) a schematic perspective view of a sixth lifting arm 112 and the lifting unit 12 in a position prior to sliding the lifting arm 112 onto the lifting unit fixing pin 62; and in partial FIG. 8(*b*), a vertical sectional view of the sixth lifting arm 112 and the lifting unit 12 in the fixing position of the lifting arm; and in partial FIG. 8(*c*), an enlarged sectional view of the cutaway of FIG. 8(*b*) with the clamping screw 116.

The lifting unit 12 in FIG. 8 corresponds to the lifting unit 12 in FIGS. 4, 6 and 7. The same elements are referred to with the same reference signs and are not explained again.

The sixth lifting arm 102 corresponds to the second lifting arm 56 shown in FIG. 4, except for the following differences, wherein the same elements are referred to with the same reference signs and are not explained again to avoid repetitions.

The sixth lifting arm 112 has a screw opening 114 provided with an inner thread extending between the upper side of the basic body of the lifting arm 112 and the elongated recess 64 of the same. The screw opening 114 therefore extends, with respect to the width of the sixth lifting arm 112, in the vertical direction and in the center with respect to the width of the sixth lifting arm 112 and in a region of the sixth lifting arm 112, between the rear end and the center, at a longitudinal position, below which the lifting unit fixing pin 62 is located when the lifting arm 112 is slid onto the lifting unit fixing pin 62.

A clamping screw 116 is inserted into the screw opening 114 from the top and can be screwed from a non-clamping position into a clamping position, in which its clamping lower screw end can exert a clamping force onto the lifting unit fixing pin 62 inserted into the elongated recess 64.

The screw head of the clamping screw 116 has a sufficient size for allowing the clamping screw 116 to be conveniently screwed upwards and downwards by a user.

It is preferable that, as shown in FIGS. 8(*b*) and 8(*c*), in the clamping position, in the lower side of the screw head, flanging outwardly, comes to rest on the upper side of the sixth lifting arm 112 or only slightly above it.

In FIGS. 8(*a*), 8(*b*) and 8(*c*), it is easy to imagine how the lifting arm 112 is fixed to the lifting unit 12 in a clamping manner. First, the lifting arm 112 is aligned substantially horizontally and is, with its elongated recess 64, slid onto the lifting unit fixing pin 62 until its first stopping region 45 abuts the vertical front surface 16 and its bearing region 44 abuts the horizontal supporting surface 18. In doing so, the clamping screw 116 is in a non-clamping position and its screw end is thus positioned in the plane formed by the upper end of the elongated recess 64 or above it. Then, the clamping screw 116, and at the same time the entire lifting arm 112, are brought into the clamping position by screwing the clamping screw 116 downwards until its lower screw end exerts a clamping force onto the lifting unit fixing pin 62. The detachment works in an analogous manner.

Figure 9:
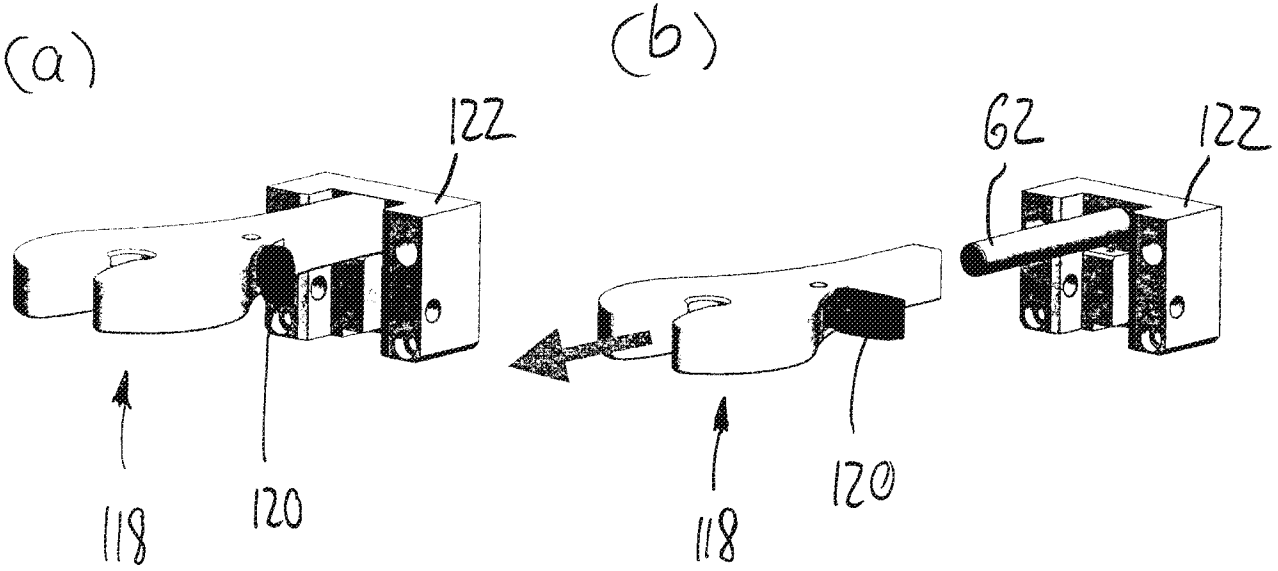
FIG. 9 shows in partial FIG. 9(*a*) a schematic perspective view of a seventh lifting arm and a third lifting unit with the lifting arm in the fixing position; and in partial FIG. 9(*b*), the seventh lifting arm and the third lifting unit in a position after pulling the lifting arm off the third lifting unit according to another exemplary embodiment of the invention.

FIG. 9 shows in partial FIG. 9(*a*) a schematic perspective view of a seventh lifting arm 118 and a third lifting unit 122 with the lifting arm 118 in the fixing position; and in partial FIG. 9(*b*), the seventh lifting arm 118 and the third lifting unit 122 in a position after pulling the lifting arm 118 off the third lifting unit 122.

The third lifting unit 122 of FIGS. 9(*a*) and 9(*b*) comprises, like the first lifting unit 12 and the second lifting unit 66, a lifting unit fixing pin 62 protruding from a vertical end surface towards the front over a vertical front surface formed by the vertical end face, and over a horizontal supporting surface below the lifting unit fixing pin 62 and corresponds in this respect to the lifting units 12 and 66.

In the third lifting unit 122, the horizontal supporting surface does, however, not extend across the entire width of the lifting unit 122 but extends only across one center region of the lifting unit 122 when viewed in the width direction.

This is sufficient for reliably supporting the lifting arm 118 with its stopping region in a tilt-proof manner. The supporting surface forms the upper side of a support block protruding from the vertical end surface towards the front when viewed in the width direction and taking up a center region below the lifting unit fixing pin 62. In addition, the third lifting unit 122 has outer lateral jaws protruding from the vertical surface towards the front.

The seventh lifting arm 118 comprises, like all of the lifting arms described above, an elongated recess extending from the rear longitudinal end of the basic body across part of the longitudinal direction of the same towards the front longitudinal front end, and having a depth of equal size or slightly larger than the length of the lifting unit fixing pin 62. In addition, the seventh lifting arm 118 also comprises a rear vertical stopping region for the front surface of the third lifting unit 122 and a bearing region for the supporting surface of the lifting unit 112. The bearing region is, in turn, formed by the rear end of the lower side of the basic body of the seventh lifting arm 118.

Like the lifting arm 28 according to FIG. 2, the seventh lifting arm 118 has two front claw extensions having an agitating stick insertion recess arranged at the very front and a fastening extension fastening recess having a suitable fastening unit for a mixing vessel, in particular a threaded section, arranged behind it.

The agitating stick insertion section is adapted such as to widen towards the front and such that the distance between the inner sides of the claw extensions facing one another is correspondingly enlarged towards the front. This facilitates inserting an agitating stick arranged in a mixing vessel from the front and allows for guiding it backwards towards the fastening extension fastening region.

The basic body of the seventh lifting arm 118 has a shape tapered towards the back, which can be broadly speaking referred to as fork-like, with two front claw extensions or fork prongs.

Like the fifth lifting arm 98 according to FIG. 7, the seventh lifting arm 118 shown in FIG. 9 also comprises a fixing means adapted in the form of a clamping lever 120. To this end, a clamping lever recess is provided on the side of the basic body, extending between the elongated recess and the right side surface of the basic body. This clamping lever recess has the clamping lever 120 arranged therein, which can be moved about a vertical axis between a non-clamping position and a clamping position. In FIG. 9(*b*), the clamping lever 120 is shown in its non-clamping position, in which its clamping jaw is positioned in the vertical plane or outside the vertical plane extending through the right end of the elongated recess. In this non-clamping position, the lifting arm 118 can be slid onto the lifting unit 122 or, as shown in FIG. 9(*b*), pulled off it.

In the position of the lifting arm 118, in which the lifting unit fixing pin is inserted into the elongated recess, the stopping region abuts the vertical front surface, and the bearing region rests on the horizontal supporting surface, the clamping lever 120 can now be pivoted into the clamping position, shown in FIG. 9(*a*) by way of example, such that the actuation end of the clamping lever 120 is pivoted towards the front.

Figure 10:
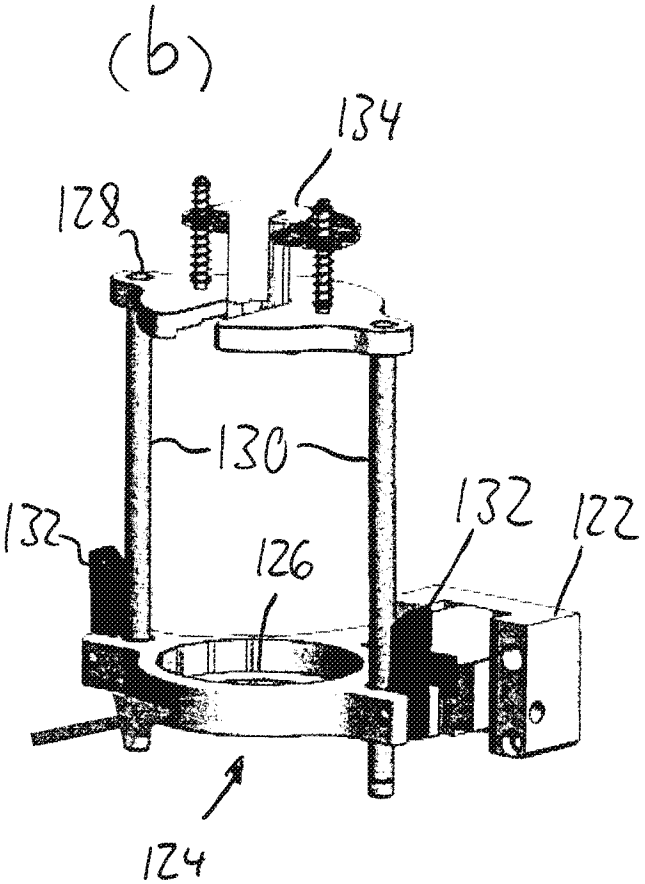
FIG. 10 shows in partial FIG. 10(*a*) a schematic perspective view of an eighth lifting arm and the third lifting unit according to FIG. 9 in a position prior to sliding the lifting arm onto the lifting unit fixing pin; and in partial FIG. 10(*b*), the eighth lifting arm and the third lifting unit with the eighth lifting arm in the fixing position according to another exemplary embodiment of the invention.
Figure 10:
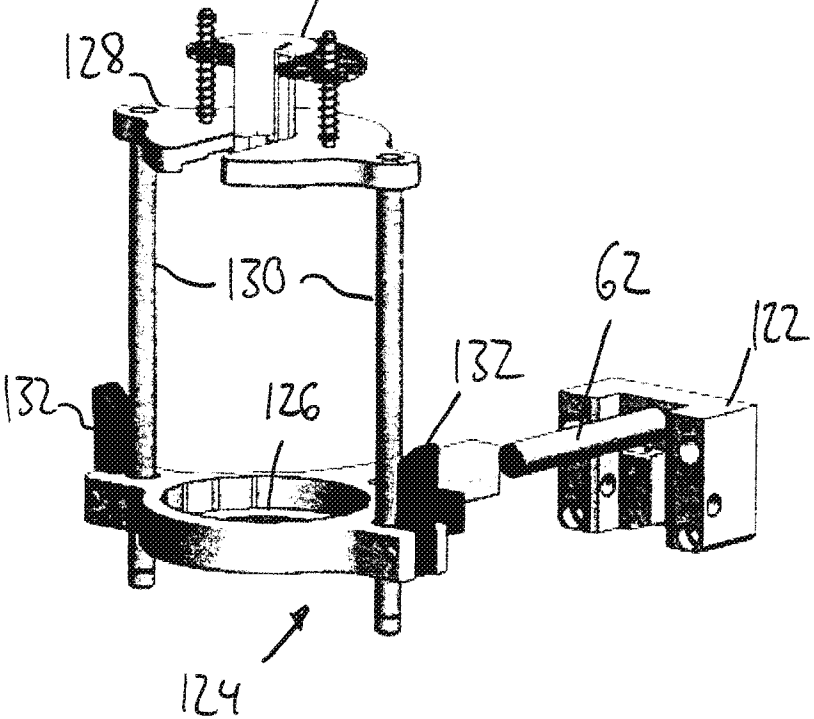

FIG. 10 shows in partial FIG. 10(*a*) a schematic perspective view of an eighth lifting arm 124 and the third lifting unit 122 in a position prior to sliding the lifting arm 124 onto the lifting unit fixing pin 62; and in partial FIG. 10(*b*), the eighth lifting arm 24 and the third lifting unit 122 with the eighth lifting arm 124 in the fixing position.

The third lifting unit 122 according to FIG. 10 corresponds to the lifting unit 122 illustrated and described according to FIG. 9. The same elements are referred to with the same reference signs and are not explained again.

The eighth lifting arm 124 corresponds to the seventh lifting arm 118 shown in FIG. 9 with respect to its clamping lever, its first longitudinal end with the stopping region and the bearing region, and with respect to its elongated recess. These elements are not explained again.

With respect to the eighth lifting arm 124, the fastening unit for the mixing vessel has a different design. This mixing vessel fastening unit comprises a mixing vessel contact surface 126 formed in the front section of the basic body, in particular of an annular shape or plate-like, which in particular comprises a circumferential edge facing inwards and having the shape of a cylindrical segment. A mixing vessel may be placed on this mixing vessel contact surface 126, the diameter of which corresponds, at least at the lower edge, to the inner diameter of the circumferential edge of the mixing vessel contact surface 126, such that the mixing vessel is at the same time arranged in a slide-proof manner.

The mixing vessel fastening unit of the eighth lifting arm 124 further comprises an upper clamping body 128 for the lid plate of the mixing vessel or for the bottom plate of the mixing vessel, which is arranged by means of two vertical rods, which are arranged next to the mixing vessel, in particular at the left and the right side thereof, and can be displaced upwards and downwards with respect to the basic body of the eighth lifting arm 124. These vertical rods 130 are fixedly connected to a clamping plate of the upper clamping body 128 and extend through corresponding guiding regions provided next to the mixing vessel contact surface 126 in the basic body, in particular guiding recesses in the basic body. In addition, locking levers 132 on the basic body side are provided, which can be displaced between a free running position, in which the vertical rods 130 can be displaced freely upwards and downwards within the guiding recesses, and a locking position, in which the locking levers 132 exert a clamping force onto the vertical rods and thus fix the upper clamping body 128 in a desired vertical position spaced apart from the basic body. In addition, the upper clamping body 128 also comprises a guiding attachment 134 having a guiding recess, facing towards the front, for an agitating stick protruding from the mixing vessel.

In order to attach the mixing vessel to the lifting arm 124 and to arrange and fix the lifting arm 124 to the third lifting unit 122 in a clamping manner, the procedure is as follows.

First, the lifting arm 124 is, with its elongated recess, slid onto the lifting unit fixing pin 62, with or without the upper clamping body 128 and displaceable rods 130, until its stopping region abuts the vertical front surface of the lifting unit 122 and its bearing region rests on the horizontal supporting surface of the same. In doing so, the clamping lever 120 is in the non-clamping position in order to allow the sliding process. Then, the clamping lever 120 is moved from the non-clamping position into the clamping position, in which its clamping jaw exerts a clamping force onto the lifting unit fixing pin 62 and fixes the lifting arm 124 in a securely-clamped manner with respect to the lifting unit 122.

If the upper clamping body 128 has already been attached with its displaceable rods 130 to the lifting arm 124, the upper clamping body 128 is moved sufficiently upwards, or is completely removed by means of the displaceable rods 130 by setting the locking levers 132 in the free running position, such that the desired mixing vessel can be placed with its upper or lower end on the mixing vessel contact area.

Then the displaceable rods 130, if they have been taken out, are inserted into the guiding recesses.

Subsequently, the upper clamping body 128 and the displaceable rods 130 are displaced downwards until the upper clamping body 128 abuts the lid plate of the mixing vessel or the bottom plate of the mixing vessel and so the agitating stick protruding from the mixing vessel is received in the guiding attachment 134. Then the locking levers 132 are pivoted into their respective latching positioned.

The mixing vessel is taken out and the lifting arm 124 is released in an analogous manner.

Although the present patent application, in particular with reference to FIGS. 1 through 3 and 10, has always referred to a mixing vessel attached to the respective fastening unit of the lifting arm with its fastening extension extending from the lid, the present invention is not limited thereto.

Alternatively, it is also possible to have a mixing vessel having a lower fastening extension extending from its bottom attached to the fastening unit of the lifting arm, in particular inserted, screwed in, latched, clicked in from above or attached in any other way to the fastening unit of the lifting arm from above.

The invention claimed is:

1. An exchangeable pharmacy formulation preparation device lifting arm for being arranged on a lifting unit of a pharmacy formulation preparation device for preparing an individual pharmaceutical product and for attaching a mixing vessel for such an individual pharmaceutical product thereto, comprising:

a substantially elongated basic body, in which an elongated recess for sliding the basic body onto a lifting unit fixing pin is provided, the elongated recess extending from a first longitudinal end of the basic body over part of the longitudinal direction of the basic body towards the opposite second longitudinal end;

wherein the first longitudinal end of the basic body comprises a stopping region for a front surface of the lifting unit and a bearing region for a supporting surface of the lifting unit; and wherein a fastening unit for the mixing vessel is provided near the second longitudinal end of the basic body;

wherein the pharmacy formulation preparation device lifting arm is adapted for being magnetically fixed to a lifting unit of the pharmacy formulation preparation device for preparing an individual pharmaceutical product and for attaching the mixing vessel for such an individual pharmaceutical product thereto;

wherein at the front end of the longitudinal recess of the basic body, a magnetic pin opening is provided extending in a radial direction and having a pin with a magnet inserted therein, wherein the pin with the magnet can be moved in a substantially radial direction between a position of magnetic attraction, in which the magnet is arranged at the front end of the longitudinal recess of the basic body, and a release position, in which the magnet is displaced radially outwards from the front end of the longitudinal recess;

wherein the magnetic pin opening extends transversely through the basic body and comprises a first section having a smaller diameter and a second section having a larger diameter;

wherein the pin with the magnet comprises a first section having a smaller diameter and a second section having a larger diameter; and wherein at the end of the magnetic pin opening having the larger diameter, a spring is arranged, in particular having a closing cap with respect to the basic body.

2. The exchangeable pharmacy formulation preparation device lifting arm according to claim 1, wherein the stopping region is formed by the front surface of the first longitudinal end of the basic body and the bearing region is formed by the end region of the lower side of the basic body.

3. The exchangeable pharmacy formulation preparation device lifting arm according to claim 1, wherein the fastening unit comprises a mixing vessel fastening extension fastening region, which is adapted as a recess extending from the lower side to the upper side of the basic body;

wherein the recess particularly has a substantially cylindrical shape, the inner surface of the recess has at least one threaded region provided thereon for screwing the mixing vessel thereon;

wherein the fastening unit is adapted as a fastening claw having two claw extensions, wherein the fastening claw comprises a mixing vessel fastening extension fastening region, which is adapted as a recess extending from the lower side to the upper side of the basic body, and an agitating stick insertion region, which is adapted as a recess extending from the lower side to the upper side of the basic body and extends from the second longitudinal end of the basic body to the mixing vessel fastening extension fastening region.

4. The exchangeable pharmacy formulation preparation device lifting arm according to claim 3, wherein the recess of the mixing vessel fastening extension fastening region has a substantially cylindrical shape, the inner surface of the recess of the mixing vessel fastening extension fastening region has at least one threaded region provided thereon for screwing the mixing vessel thereon, wherein the recess of the agitating stick insertion region comprises two inner surfaces facing each other with a substantially constant distance.

5. The exchangeable pharmacy formulation preparation device lifting arm according to claim 3, wherein the recess of the mixing vessel fastening extension fastening region comprises an upper substantially cylindrical recess region and a lower substantially cylindrical recess region having a larger diameter, wherein, at the transition between the lower and the upper substantially cylindrical recess region, a supporting face, of an annular shape, is provided facing downwards, which forms a stopper for a step of a fastening extension of the mixing vessel;

wherein the upper recess region comprises at least one threaded region for screwing the mixing vessel thereon;

wherein at the upper end of the upper substantially cylindrical recess region, the mixing vessel fastening extension fastening region comprises a screw-in limiting region having a smaller inner diameter than the inner diameter of the inner thread of the mixing vessel fastening extension fastening region;

wherein the screw-in limiting region forms a screw-in limiting surface on its lower side towards the lower substantially cylindrical recess region; and wherein the screw-in limiting surface forms a stopper for a stopper surface of a fastening extension.

6. The exchangeable pharmacy formulation preparation device lifting arm according to claim 1, wherein the fastening unit comprises a contact area for the mixing vessel provided within the basic body; an upper clamping body for the lid plate or the bottom plate of the mixing vessel; and at least one displaceable rod, by means of which the upper clamping body can be displaced relative to the basic body in the vertical direction;

wherein the at least one displaceable rod is fixed to at least one of the upper clamping body or the basic body and is displaceable relative to the respective other element of the upper clamping body or of the basic body and can be locked in a desired height position by at least one locking lever.

7. The exchangeable pharmacy formulation preparation device lifting arm according to claim 6, wherein the clamping body comprises a guiding attachment for an agitating stick arranged in the mixing vessel, the upper clamping body comprises a guiding recess, which is open towards the front, for an agitating stick arranged in the mixing vessel.

8. The exchangeable pharmacy formulation preparation device lifting arm according to claim 1, wherein the spring pretensions the pin with the magnet such that the annular step of the pin between the first section having the smaller diameter and the second section having the larger diameter abuts the annular stopper of the magnetic pin opening between the first section having a smaller diameter and the second section having a larger diameter;

that the magnet is arranged in a position of magnetic attraction at the front end of the longitudinal recess of the basic body;

that the end region of the first section, having a smaller diameter, of the pin protrudes from the magnetic pin opening;

wherein the spring and the pin are adapted such that when the end region of the first section, having a smaller diameter of the pin, is manually pressed into the magnetic pin opening to an extent that the end region of the pin is substantially positioned within the plane of the respective outer side of the basic body, the pin with the magnet is in the release position and the magnet is displaced radially outwards from the front end of the longitudinal recess.

9. An exchangeable pharmacy formulation preparation device lifting arm for being arranged on a lifting unit of a pharmacy formulation preparation device for preparing an individual pharmaceutical product and for attaching a mixing vessel for such an individual pharmaceutical product thereto, comprising:

a substantially elongated basic body, in which an elongated recess for sliding the basic body onto a lifting unit fixing pin is provided, the elongated recess extending from a first longitudinal end of the basic body over part of the longitudinal direction of the basic body towards the opposite second longitudinal end;

wherein the first longitudinal end of the basic body comprises a stopping region for a front surface of the lifting unit and a bearing region for a supporting surface of the lifting unit; and wherein a fastening unit for the mixing vessel is provided near the second longitudinal end of the basic body;

wherein the pharmacy formulation preparation device lifting arm is adapted for being fixed to a lifting unit of the pharmacy formulation preparation device for preparing an individual pharmaceutical product and for attaching the mixing vessel for such an individual pharmaceutical product thereto;

wherein at the first longitudinal end of the basic body, at the lower bearing region for a supporting surface of the lifting unit, an engagement recess is provided for an engagement element, an engagement element on the lifting unit side, an engagement ball on the lifting unit side, which is radially pretensioned by a spring, to engage with the engagement recess for fixing the basic body; and wherein the engagement recess has the shape of a ball segment and the engagement recess is provided in the lower bearing region below the longitudinal recess.

10. An exchangeable pharmacy formulation preparation device lifting arm for being arranged on a lifting unit of a pharmacy formulation preparation device for preparing an individual pharmaceutical product and for attaching a mixing vessel for such an individual pharmaceutical product thereto, comprising:

a substantially elongated basic body, in which an elongated recess for sliding the basic body onto a lifting unit fixing pin is provided, the elongated recess extending from a first longitudinal end of the basic body over part of the longitudinal direction of the basic body towards the opposite second longitudinal end;

wherein the first longitudinal end of the basic body comprises a stopping region for a front surface of the lifting unit and a bearing region for a supporting surface of the lifting unit;

wherein a fastening unit for the mixing vessel is provided near the second longitudinal end of the basic body;

wherein the pharmacy formulation preparation device lifting arm is adapted for being fixed to a lifting unit of a pharmacy formulation preparation device for preparing an individual pharmaceutical product in a clamping manner and for attaching the mixing vessel for such an individual pharmaceutical product thereto;

wherein the basic body comprises a clamping lever recess extending between the longitudinal recess and an outer surface, in particular lateral outer surface, of the basic body arranged between the two longitudinal ends of the basic body, wherein a clamping lever is arranged within the clamping lever recess, which lever can be moved between a non-clamping position and a clamping position, in which, through a clamping region thereof, a clamping force can be exerted on a lifting unit fixing pin inserted into the longitudinal recess; and wherein the clamping lever can be pivoted about at least one of a stationary or rotational axis extending within the clamping lever recess from the upper side towards the lower side of the basic body, wherein the clamping lever comprises an actuation end facing away from the longitudinal recess and a clamping jaw facing towards the longitudinal recess, wherein the clamping lever is pivotable about the axis such that, in the non-clamping position, a clamping jaw is located outside the longitudinal recess and, in the clamping position, the clamping jaw protrudes into the longitudinal recess when the lifting unit fixing pin is not inserted.

11. An exchangeable pharmacy formulation preparation device lifting arm for being arranged on a lifting unit of a pharmacy formulation preparation device for preparing an individual pharmaceutical product and for attaching a mixing vessel for such an individual pharmaceutical product thereto, comprising:

a substantially elongated basic body, in which an elongated recess for sliding the basic body onto a lifting unit fixing pin is provided, the elongated recess extending from a first longitudinal end of the basic body over part of the longitudinal direction of the basic body towards the opposite second longitudinal end;

wherein the first longitudinal end of the basic body comprises a stopping region for a front surface of the lifting unit and a bearing region for a supporting surface of the lifting unit;

wherein a fastening unit for the mixing vessel is provided near the second longitudinal end of the basic body;

wherein the pharmacy formulation preparation device lifting arm is adapted for being fixed to a lifting unit of the pharmacy formulation preparation device for preparing an individual pharmaceutical product in a clamping manner and for attaching the mixing vessel for such an individual pharmaceutical product thereto; and wherein in the basic body, a screw opening having an inner thread is provided, which extends between the longitudinal recess and an outer side of the basic body, at least one of positioned on the top and on the bottom, and wherein a clamping screw is inserted into the screw opening and can be screwed in from a non-clamping position into a clamping position, in which, through its clamping screw end, a clamping force can be exerted on a lifting unit fixing pin inserted into the longitudinal recess.

* * * * *